US011448007B2

(12) United States Patent
Woodward et al.

(10) Patent No.: US 11,448,007 B2
(45) Date of Patent: Sep. 20, 2022

(54) LOW PROFILE PANEL HANDLE ASSEMBLY AND METHODS FOR SAME

(71) Applicant: Marvin Lumber and Cedar Company, LLC, Eagan, MN (US)

(72) Inventors: Bradley D. Woodward, Warroad, MN (US); Ross Michael Hollermann, Salol, MN (US)

(73) Assignee: Marvin Lumber and Cedar Company, LLC, Eagan, MN (US)

( * ) Notice: Subject to any disclaimer, the term of this patent is extended or adjusted under 35 U.S.C. 154(b) by 0 days.

(21) Appl. No.: 16/794,979

(22) Filed: Feb. 19, 2020

(65) Prior Publication Data

US 2020/0263490 A1 Aug. 20, 2020

Related U.S. Application Data

(60) Provisional application No. 62/807,413, filed on Feb. 19, 2019.

(51) Int. Cl.

| | |
|---|---|
| ***E06B 7/28*** | (2006.01) |
| *E06B 3/36* | (2006.01) |
| *E06B 5/00* | (2006.01) |
| *E06B 9/52* | (2006.01) |
| *E06B 3/32* | (2006.01) |

(52) U.S. Cl.

CPC ..... *E06B 7/28* (2013.01); *E06B 3/325* (2013.01); *E06B 3/36* (2013.01); *E06B 5/003* (2013.01); *E06B 9/52* (2013.01)

(58) Field of Classification Search

CPC ... E06B 7/28; E06B 3/36; E06B 5/003; E06B 9/52; E06B 3/325

USPC ..... 52/204.5, 204.62, 204.67, 204.68, 204.1; 49/460, 461

See application file for complete search history.

(56) References Cited

U.S. PATENT DOCUMENTS 1,453,280 A 5/1923 Park
2,121,714 A * 6/1938 Rose ..... E06B 3/44 49/63

(Continued)

FOREIGN PATENT DOCUMENTS

CN 112854994 A * 5/2021

OTHER PUBLICATIONS

"Canadian Application Serial No. 3,072,916, Office Action dated Feb. 2, 2022", 3 pgs.

(Continued)

*Primary Examiner* — Brent W Herring
(74) *Attorney, Agent, or Firm* — Schwegman Lundberg & Woessner, P.A.

(57) ABSTRACT

A fenestration assembly includes a fenestration frame and a sash movably coupled with the fenestration frame. The sash includes a daylight opening having a daylight opening profile. A low profile handle assembly is coupled with the fenestration frame and the sash. The low profile handle assembly includes a sash handle coupled with the sash and a handle socket in the fenestration frame. The handle socket is configured for reception of the sash handle. The low profile handle assembly has a composite handle profile including the sash handle received in the handle socket. The composite handle profile is outside of the daylight opening profile, and the daylight opening is unobstructed at least from the low profile handle assembly.

27 Claims, 15 Drawing Sheets

(56) References Cited

U.S. PATENT DOCUMENTS

| | | | | | |
|---|---|---|---|---|---|
| 2,317,686 | A * | 4/1943 | Kuyper | E06B 9/52 | 160/101 |
| 2,893,072 | A * | 7/1959 | Marchbank | E06B 3/44 | 49/416 |
| 3,396,489 | A * | 8/1968 | Cirone | E05B 65/1033 | 49/276 |
| 3,461,609 | A * | 8/1969 | Armstrong | E06B 3/5009 | 49/324 |
| 5,741,031 | A * | 4/1998 | Bauman | E05B 3/00 | 292/139 |
| 5,791,700 | A * | 8/1998 | Biro | E05C 9/043 | 292/36 |
| 6,640,389 | B2 * | 11/2003 | Van Klompenburg | E05F 11/16 | 16/429 |
| D522,837 | S * | 6/2006 | Vetter | D8/306 | |
| 7,147,256 | B2 * | 12/2006 | Gill | E05F 11/16 | 292/336.3 |
| D620,347 | S * | 7/2010 | Siverhus | D8/400 | |
| D621,255 | S * | 8/2010 | Siverhus | D8/400 | |
| 9,404,302 | B2 * | 8/2016 | Evensen | E05F 11/02 | |
| 2007/0011961 | A1 * | 1/2007 | Annes | E06B 1/08 | 52/204.1 |
| 2020/0347638 | A1 * | 11/2020 | Renner | E05B 1/003 | |

OTHER PUBLICATIONS

"Canadian Application Serial No. 3,072,916, Response Filed May 26, 2022 to Office Action dated Feb. 2, 2022", 11 pgs.

* cited by examiner

LOW PROFILE PANEL HANDLE ASSEMBLY AND METHODS FOR SAME

CLAIM OF PRIORITY

This patent application claims the benefit of priority of Woodward et al., U.S. Provisional Patent Application Ser. No. 62/807,413, entitled "LOW PROFILE PANEL HANDLE ASSEMBLY AND METHODS FOR SAME," filed on Feb. 29, 2019, which is hereby incorporated by reference herein in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Marvin Lumber and Cedar Company (d/b/a Marvin Windows and Doors), Warroad, Minn. All Rights Reserved.

TECHNICAL FIELD

This document pertains generally, but not by way of limitation, to fenestration operators and fenestration assemblies including fenestration operators.

BACKGROUND

Fenestration operators are included with fenestration assemblies, such as windows and doors, to facilitate opening and closing of movable panels, such as sashes, doors or the like. With casement, awning and venting picture window assemblies the sash rotates or translates relative to the fenestration frame. For instance, the sash rotates from a closed position to an open position with respect to the fenestration frame.

In some examples, the fenestration operator includes an operator such as a crank and drive mechanism that moves the sash between the open and closed positions. In some examples, the hardware is coupled along the sill of the window assembly for access by the operator.

SUMMARY

The present inventors have recognized, among other things, that a problem to be solved can include minimizing profiles of operators used with fenestration assemblies including windows and doors. In some examples, hardware extends significantly beyond the profile of the fenestration frame and protrudes noticeably away from fenestration assembly into a daylight opening (e.g., a portion of the fenestration assembly where the panes allow light to transmit from a first side of the fenestration assembly to a second side of the fenestration assembly). For example, hardware extends away from the fenestration frame because of the handle and knob configuration used to actuate the operator mechanism, for instance like a crank. The protruding hardware interferes with window treatments, like drapes, curtains, shades or the like. Additionally, the installed hardware extends away from the frame during shipping, and in some examples causes damage to adjacent fenestration assemblies (including glass panes) stored against the hardware. Further, because the hardware is prominently placed along the window frame (e.g., proximate the middle of the sill) the hardware detracts from the appearance of the rest of the window including finished wood, painted sills, panels or the like, and in some examples (as described above) extends into the daylight opening of the fenestration assembly. In another example, the hardware interrupts the finished appearance of the window frame and provides an unappealing distraction from a minimized and sleek aesthetic.

The present subject matter provides a solution to this problem, with operator assemblies outside a daylight opening profile. The operator assemblies described herein include low profile handle assemblies having sash handles and handle sockets configured to receive sash handles. The composite profile of the handle assemblies (e.g., including the handle socket and the sash handle received therein) is outside of the daylight opening profile. Even with the minimized profile, the sash handle is accessible while the sash is closed or open. The handle socket includes an opening directed toward the exterior face of the fenestration frame (for reception of the sash handle) and toward the inner perimeter of the fenestration assembly to provide access to the sash handle. Additionally, the sash handle projects toward the interior face of the fenestration frame to facilitate grasping and pulling or pushing of the handle and the associated panel (e.g., a sash, door, or the like). In another example, a grip surface of the sash handle opens toward the inner perimeter of the fenestration assembly to facilitate grasping of the handle by the user with the sash handle seated in the handle socket or projected away (e.g., with the sash open).

In other examples, the low profile handle assembly is concealed to further minimize the appearance of the assembly. For instance, the handle socket and the sash handle are recessed relative to one or more of the fenestration frame or the sash frame of the sash to minimize the appearance of the handle assembly. In another example, a low profile screen assembly is coupled with the fenestration assembly. The screen panel frame of the screen assembly covers the low profile handle assembly (e.g., with the sash in a closed position) and thereby conceals the handle assembly to enhance the aesthetic appeal of the fenestration assembly. When opening of the sash is specified, the operator opens the screen assembly to access the sash, and pushes the sash to open. When the sash is open, the screen assembly is optionally closed (e.g., to prevent the ingress of pests, debris or the like) and at least the handle socket is again concealed. If closing is specified, the screen assembly is opened and the user pulls the sash toward the fenestration frame, for instance with the sash handle. The sash handle is readily seated in the handle socket, and with closing of the screen assembly the low profile handle assembly is covered and thereby concealed.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
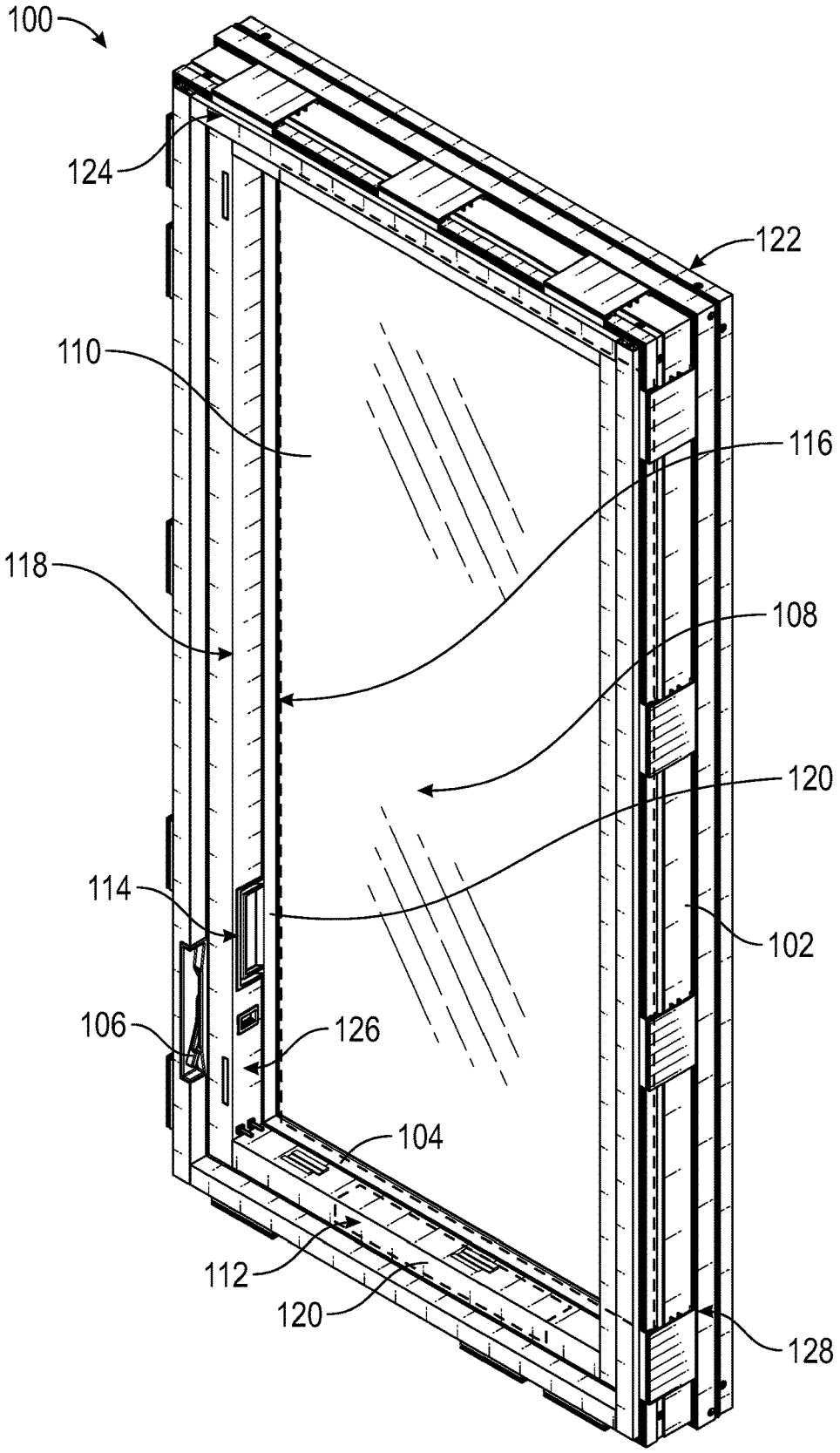
FIG. 1 is a perspective view of a fenestration assembly including one example of a sash handle assembly.

FIG. 1 is a perspective view of a fenestration assembly 100 (e.g., a door, window, or the like) including one example of a sash handle assembly. The fenestration assembly 100 includes a fenestration frame 102. The fenestration frame 102 is configured to be coupled to a structure, including (but not limited to) a single-family residence, a multi-family residence, a municipal building, an office building, a warehouse, or the like. In an example, a casement window is coupled to a wall of a residence (e.g., coupled with a rough opening of the structure). For instance, the fenestration frame 102 is optionally coupled with one or more of a window sill, header, or stud of a frame for the structure.

The fenestration assembly 100 includes a panel, for instance a sash 104. In some examples, the sash 104 is movably coupled with the fenestration frame 102. For instance, the fenestration assembly 100 includes a hinge coupling the sash 104 with the fenestration frame 102. The hinge and associated hardware (e.g., operating mechanism or the like) facilitates relative motion between the sash 104 and the fenestration frame 102. Accordingly, the sash 104 is moveable between a closed position and an open position (e.g., in this example with the sash 104 rotated about the hinge away from the closed position). FIG. 1 shows the sash 104 in the closed position.

The fenestration assembly 100 optionally includes a sash latch operator 106, and the sash latch operator 106 facilitates securing the fenestration assembly 100. For example, manipulation (e.g., by a user) of the sash latch operator 106 engages or disengages a lock assembly (e.g., a keeper and latch) that secures the sash 104 in the closed position.

The sash 104 includes a daylight opening 108 that facilitates transmission of light through fenestration assembly 100. For example, the fenestration assembly 100 includes a pane 110 (e.g., a transparent or translucent pane) to provide the daylight opening 108. The glass pane 110 includes, but is not limited to, a pane of glass, plastic, an insulated glazing unit ("IGU"), or the like.

The fenestration assembly 100 optionally includes a sash operating mechanism 112 (e.g., linkages, drives, or the like). In an example, the sash operating mechanism 112 includes actively driven mechanisms such as a crank driven (e.g., hand operated) mechanism, motor driven mechanism, or passive mechanisms including linkages configured to guide movement of the sash 104 (e.g., between the closed position and the open position). In another example, the sash operating mechanism 112 minimizes collisions between the sash 104 and the frame 102. For instance, the sash operating mechanism 112 includes damping cylinders, bias elements, elastic features or the like configured to minimize collisions or the force of collision Further, the sash operating mechanism 112 maintains the sash 104 in a specified (e.g., square, true, or the like) orientation with the frame, or the like. In other examples, the sash operating mechanism 112 cooperates with hinges, guides, or the like to maintain the sash 104 in a specified orientation with the fenestration frame 102.

As described herein, the sash 104 is moveable between a closed position and an open position. The fenestration assembly 100 includes a sash handle assembly 114 that facilitates movement of the sash 104. For example, the sash handle assembly 114 facilitates pushing and pulling of the sash 104 to move the sash 104 between the closed position and the open position, including intermediate positions therebetween. The sash handle assembly 114 includes a minimized profile as described herein. In an example, the sash handle assembly 114 is concealed with one or more components of the fenestration assembly 100 to minimize obstruction of the daylight opening 108 (e.g., minimized includes, but is not limited to a minimal obstruction of ⅛ inch or less, 1/16 inch or less, or no intrusion into the daylight opening 108).

In an example, the sash handle assembly 114 is outside with a daylight opening profile 116 (shown in dashed lines in FIG. 1) of the daylight opening 108. For example, the daylight opening profile 116 indicates the overall footprint, and perimeter of the daylight opening 108. The sash handle assembly 114 is outside of (e.g., misaligned with, offset from, spaced from, recessed from, or the like) the daylight opening profile 116. Accordingly, the misaligned sash handle assembly 114 is concealed to minimize obstruction of the daylight opening 108.

The fenestration assembly 100 includes a surround profile 118, and the surround profile 118 includes the fenestration frame 102, a sash frame 120, and profiles (e.g., one or more of a footprint, cross-section, shape, size, dimension, contour, radius, perimeter, circumference, outline, boundary, configuration, pattern, arrangement, thickness or the like) of hardware for the fenestration assembly 100, for instance, the sash handle assembly 114. As shown in FIG. 1, the surround profile 118 is outside of the daylight opening profile 116, and the daylight opening 108 is accordingly unobstructed. For example, the sash handle assembly 114 is outside with the daylight opening profile 116 to provide the unobstructed daylight opening 108.

The sash frame 120 provides structural support for the sash 104. In an example, the pane 110 extends across the sash frame 120. For instance, the sash frame 120 surrounds the pane 110 to support the pane 110. In some examples, an interface (e.g., seam, joint, junction, discontinuity, or the like) between the pane 110 and the sash frame 120 is coincident with the daylight opening profile 116.

In an example, the fenestration frame 102 includes an exterior face 122 and an interior face 124, an inner perimeter 126, and an outer perimeter 128. In an example, hardware for the fenestration assembly 100 (e.g., the sash latch operator 106 and the sash handle assembly 114) is located between an inner perimeter 126 of the fenestration assembly 100 and an outer perimeter 128 of the fenestration assembly 100. The inner perimeter 126 and the outer perimeter 128 are included in the surround profile 118. Accordingly, the inner perimeter 126 and the outer perimeter 128 are outside of the daylight opening profile 116.

Figure 2:
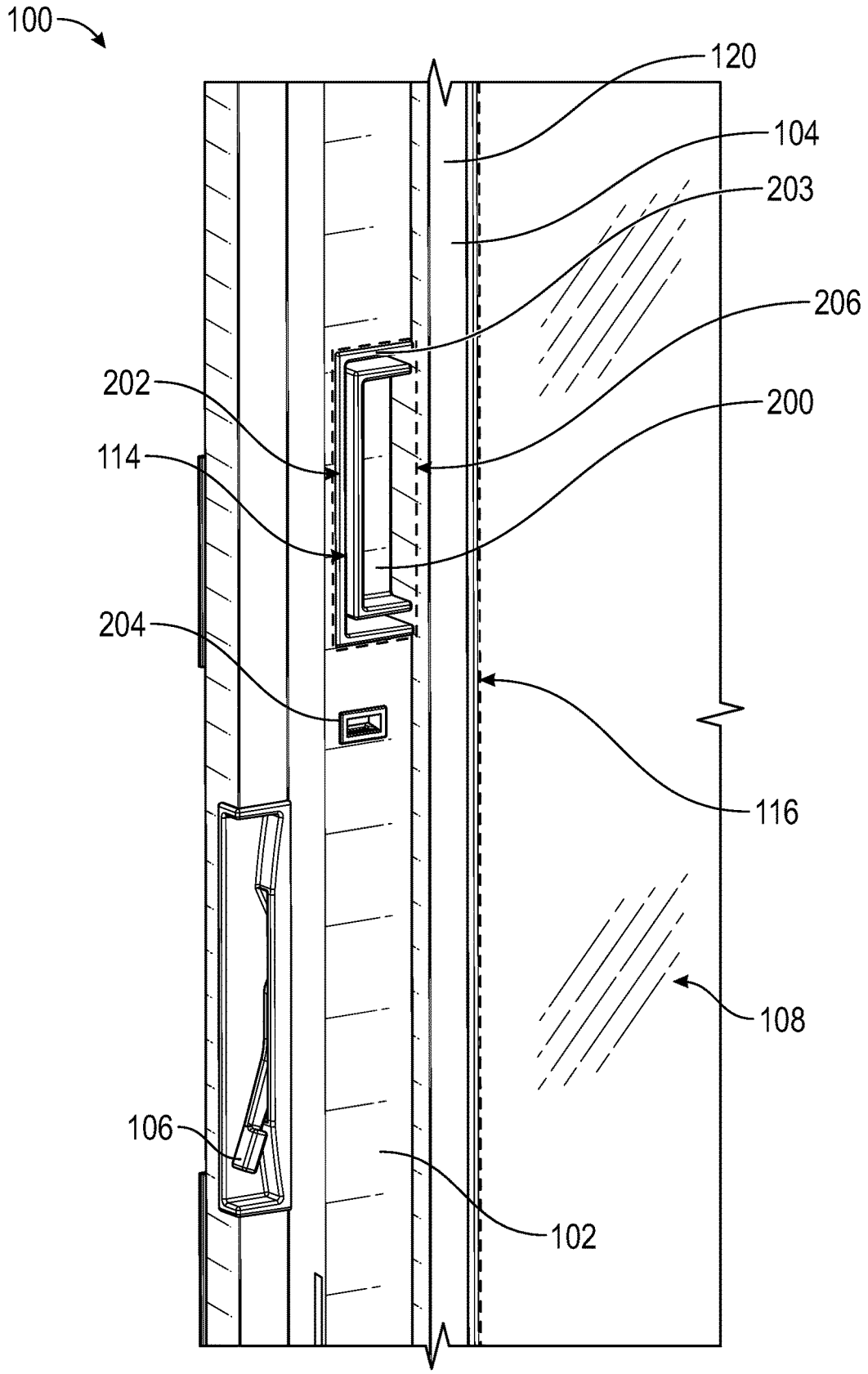
FIG. 2 is a detailed perspective view of the sash handle assembly of FIG. 1.

FIG. 2 is a detailed perspective view of the sash handle assembly 114 of FIG. 1. As described herein, the fenestration assembly 100 includes the fenestration frame 102, and the sash 104 is movably coupled to the fenestration frame 102. The sash latch operator 106 (shown in a locked configuration) facilitates securing the sash 104 in the closed position. The sash handle assembly 114 facilitates movement of the sash 104 relative to the sash 104 (e.g., between the open position and the closed position).

The sash handle assembly 114 includes a sash handle 200, and the sash handle 200 provides a grip (e.g., hand-hold, arm, or the like) to facilitate manipulation of a panel (e.g., the sash 104, or the like). For instance, the sash handle 200 is coupled to the sash 104, and the sash handle 200 allows a user to move the sash 104 between the open position and the closed position. In an example, the sash handle 200 projects from the sash toward the interior face 124 of the fenestration assembly 100.

As described herein, the sash handle assembly 114 is outside a daylight opening profile 116 (shown in dashed lines in FIG. 1). In an example, the sash handle assembly 114 includes a handle socket 202. For instance, the handle socket 202 is included in the fenestration frame 102. The handle socket 202 receives the sash handle 200 with the sash 104 in the closed position. The reception of the sash handle 200 within the handle socket 202 conceals (e.g., nests, hides, obscures, or the like) the handle 200, for instance to locate the sash handle 200 outside of the daylight opening 108 and provide an unobstructed. In some examples, the handle socket 202 includes a socket fitting 203. The socket fitting 203 is coupled with the fenestration frame 102 and receives the sash handle 200 with the sash 104 in the closed position. The socket fitting 203 is optionally flush with the fenestration frame 102 (e.g., flush with a surface on the inner perimeter 126 of the fenestration assembly 100). In an example, the sash handle assembly 114 is low profile, for instance to facilitate concealing the sash handle assembly 114 (e.g., with a screen frame, or the like).

The sash handle assembly 114 includes a composite handle profile 206, and the composite handle profile 206 is outside the daylight opening profile 116. For example, the composite handle profile 206 includes the sash handle 200 received in the handle socket 202. The sash handle 200 and the handle socket 202 are located outside of the daylight opening profile 116, and accordingly the daylight opening 108 is unobstructed by at least the sash handle assembly 114 (e.g., hardware to facilitate operation of the fenestration assembly 100 is concealed to provide the unobstructed daylight opening 108). In one example, the composite handle profile 206 is flush with components of the fenestration frame 102 (e.g., the inner perimeter 126, shown in FIG. 1) and the sash frame 120. Accordingly, the composite handle profile 206 is minimized by blending the sash handle assembly 114 with the fenestration frame 102 and the sash frame 120.

Referring again to FIG. 2, the fenestration assembly 100 optionally includes an anchor socket 204. As described herein, the anchor socket 204 is included in the fenestration frame 102 and is configured to receive a latch anchor of a screen assembly (e.g., the screen assembly 300, shown in FIG. 3). The latch anchor is seated within the anchor socket 204 to retain the screen assembly 300 in a closed position, for instance while the fenestration assembly 100 is closed. The anchor socket 204 is located outside the daylight opening 108 (e.g., the anchor socket is outside the daylight opening profile 116). Accordingly, the anchor socket 204 does not obstruct the daylight opening 108.

Figure 3:
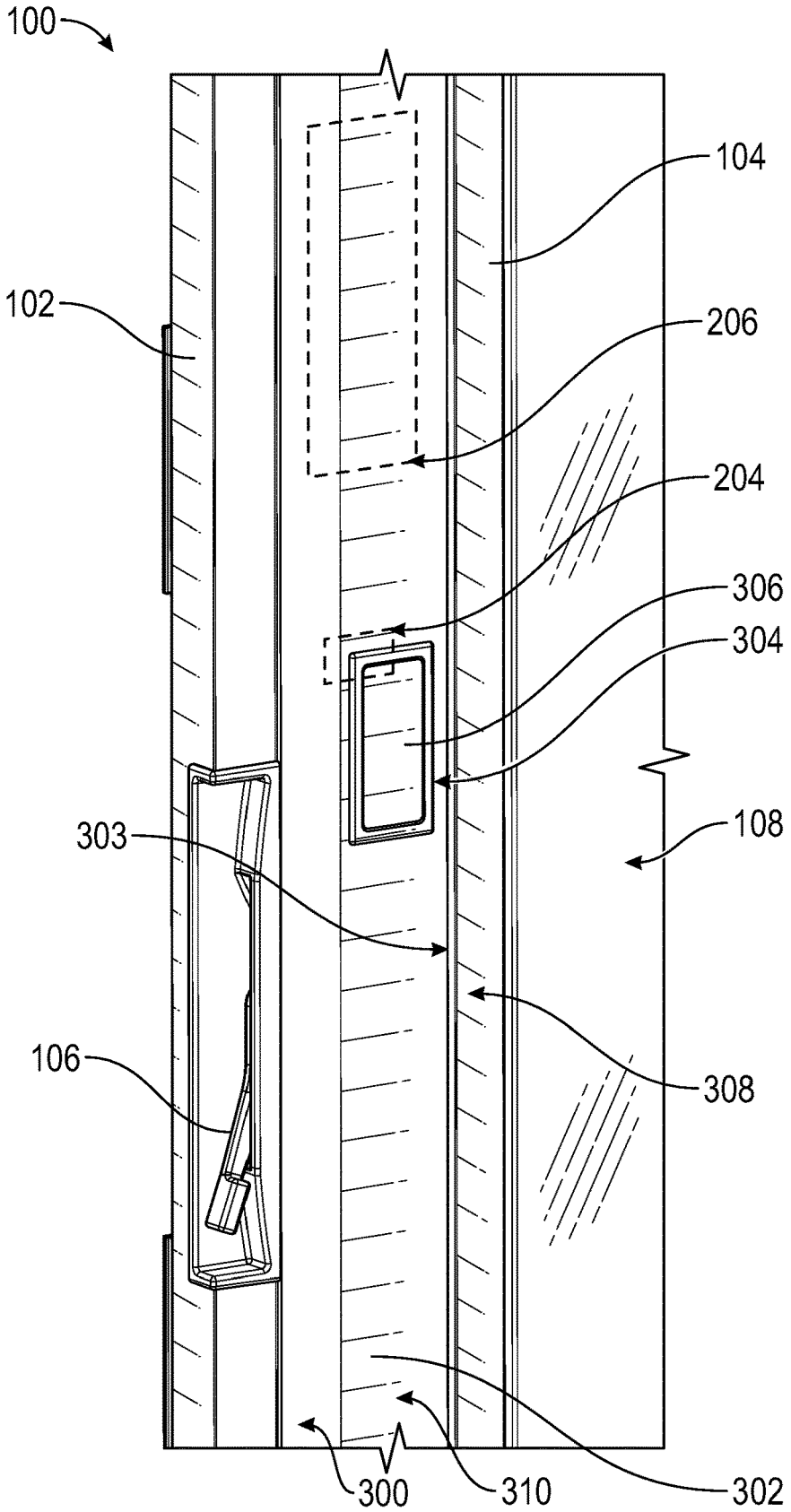
FIG. 3 is a detailed perspective view of the sash handle assembly of FIG. 1 and a screen assembly.

FIG. 3 is a detailed perspective view of the sash handle assembly 114 of FIG. 1 and a screen assembly 300. In an example, the fenestration assembly 100 includes the screen assembly 300, and the screen assembly inhibits the ingress of debris, insects, or the like through the fenestration assembly 100 with the sash 104 in the open position. As described herein, the screen assembly 300 is in one example configured for opening, for instance to access the sash 104 for movement. Additionally, the screen assembly 300 provides a minimized profile configured for one or more of blending with the remainder of the fenestration assembly 100 or recessing (e.g., misalignment, or the like) from the daylight opening 108.

In an example, the screen assembly 300 has a minimized profile. For instance, a screen frame 302 of the screen assembly 300 is located outside of the daylight opening 108. For example, a screen frame profile 303 of the screen frame 302 is outside the daylight opening profile 116 to provide an unobstructed daylight opening 108 (shown in FIG. 1). Accordingly, the daylight opening 108 is unobstructed by the screen assembly 300 (e.g., the daylight opening 108 is unobstructed because the screen frame 302 blends with the fenestration frame 102 and the sash 104).

Referring again to FIG. 3, the screen assembly 300 (e.g., the screen frame 302) conceals the sash handle assembly 114 shown in FIG. 3 with the composite handle profile 206. In yet another example, the screen frame 302 covers the sash handle assembly 114. For instance, the screen assembly 300 covers and conceals the handle socket 202 (see FIG. 2) while the fenestration assembly 100 is closed. In another example, the screen frame 302 covers and conceals the handle socket 202 and the sash handle 200 received in (e.g., nested within, or the like) the handle socket 202. In yet another example, the screen assembly 300 obscures the sash handle assembly 114 from view with the sash 104 in the closed position and the screen assembly 300 in the closed position.

In some examples, the screen assembly 300 includes a screen latch 304, and the screen latch 304 facilitates securing the screen assembly 300 in the closed position. For example, the screen latch 304 includes a latch rocker 306 and operation of the latch rocker 306 facilitates transitioning the screen latch 304 between a locked configuration and an unlocked configuration. In an example with the screen assembly 300 in the closed position (e.g., with the screen frame 302 rotated into a closed position with respect to the fenestration frame 102), the screen latch 304 engages with the anchor socket 204 (FIG. 2) of the fenestration frame 102 to secure the screen assembly 300 in the closed position. Manipulation of the latch rocker 306 (e.g., by a user, electromechanical actuator, or the like) disengages the screen latch 304 from the anchor socket 204 and facilitates transitioning the screen assembly 300 to the open position from the closed position. Accordingly, the screen latch 304 and the anchor socket 204 cooperate to secure the screen assembly 300 in the closed position.

FIG. 3 shows the composite handle profile 206 concealed by the screen assembly 300 (and recessed from the daylight opening 108). For example, the screen assembly 300, such as the screen frame 302, obscures the sash handle assembly 114 with the screen assembly 300 in the closed position. For instance, the screen assembly 300 covers and conceals the handle socket 202 (and covers and conceals the sash handle 200 received in the handle socket 202). Accordingly, the aesthetic appearance of the fenestration assembly 100 is enhanced because hardware for the fenestration assembly 100 is concealed, and the daylight opening 108 is unobstructed.

In another example, the screen latch 304 is concealed to minimize obstruction of the daylight opening 108 (e.g., minimized such as ⅛ inch or less, 1/16 inch or less, or no intrusion into the daylight opening 108). For instance, the screen latch 304 is located outside the daylight opening profile 116 (see FIG. 1). Optionally, the screen latch 304 is recessed within the screen frame 302 to conceal the screen latch 304, streamline the screen frame 302 and at the same time enhance the daylight opening 108.

In some examples, the screen frame 302 blends with other components of the fenestration assembly 100, for example one or more of the fenestration frame 102 or a fenestration panel (e.g., the sash 104). In the example shown in FIG. 3, the screen frame 302 blends into the fenestration frame 102, and accordingly appears (when closed) to be integral to the fenestration frame 102. In another example, the screen frame 302 provides a transition between the fenestration frame 102 and the sash 104. For instance, a first surface 308 of the sash 104 is aligned with a second surface 310 of the screen assembly 300 (is flush or the screen frame is recessed) to provide an unobstructed daylight opening 118. In another example, the second surface 310 of the screen assembly 300 is aligned with, blends with or the like one or more components of the fenestration frame 102.

Figure 4A:
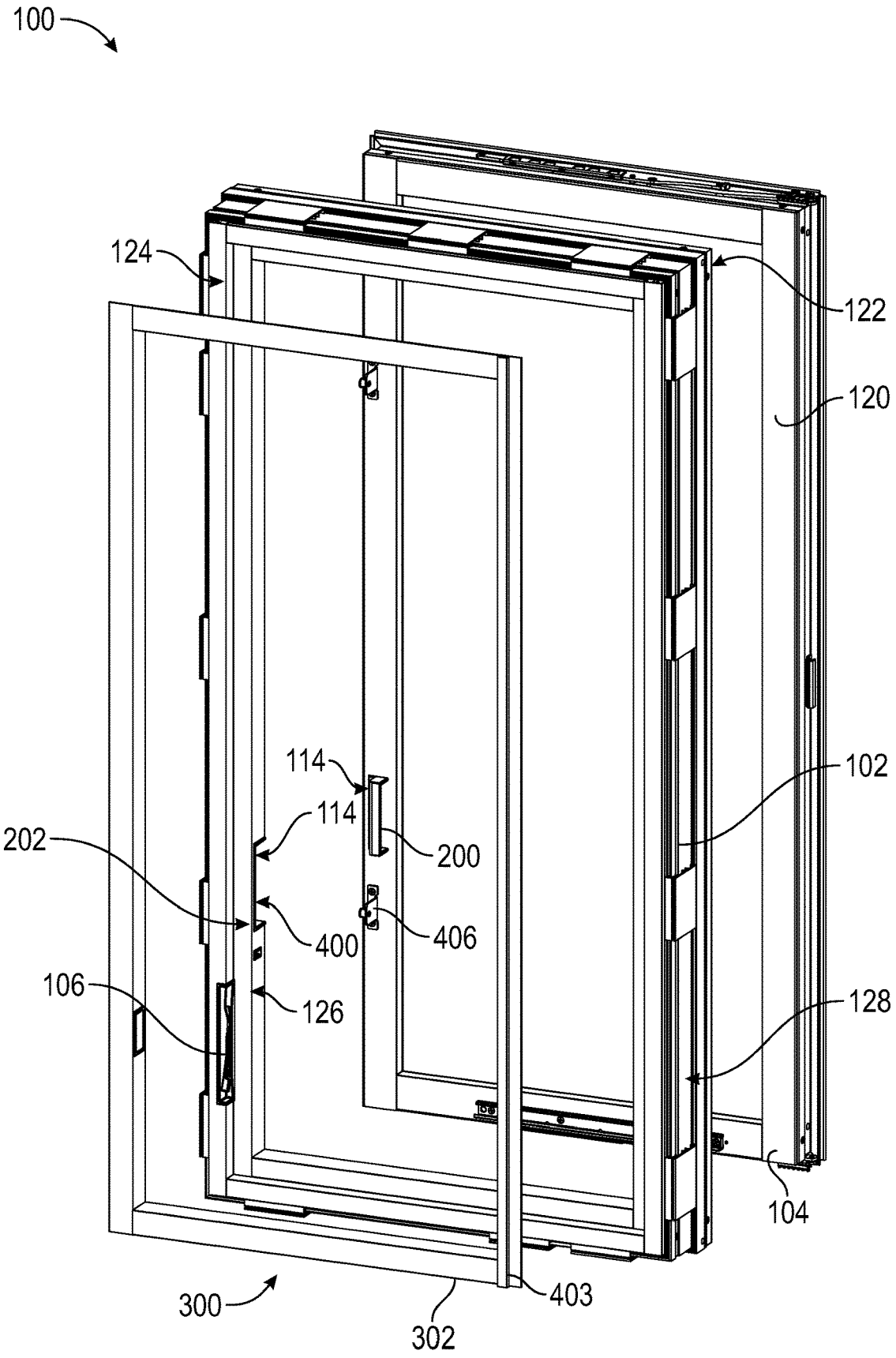
FIG. 4A is an exploded view of the fenestration assembly of FIG. 1 including the screen assembly of FIG. 3.

FIG. 4A is an exploded view of the fenestration assembly 100 of FIG. 1 including the screen assembly 300 of FIG. 3. The screen assembly 300 includes the screen frame 302 (and a screen membrane extending between the frame 302). The screen assembly 300 includes a hinge 403 that facilitates movement of the screen frame 302 relative to the fenestration frame 102. The screen frame 302 conceals the sash handle assembly 114 with the fenestration assembly 100 in a closed position, for instance with the sash handle 200 received in the handle socket 202 and the screen assembly 300 in the closed position.

As described herein, the fenestration assembly 100 includes the sash handle 200 and the handle socket 202 (shown in FIG. 2). The handle socket 202 includes a socket opening 400 in the fenestration frame 102. In an example, the socket opening 400 is directed toward one or more of the exterior face 122, the interior face 124, the inner perimeter 126, or the outer perimeter 128 of the fenestration assembly 100. For instance, the socket opening 400 shown in FIG. 4A is directed toward the exterior face 122 of the fenestration frame 102 and the inner perimeter 126 of the fenestration assembly 100. The socket opening 400 facilitates reception of the sash handle 200 by the handle socket 202, for example by accommodating the sash handle 200 within the fenestration frame 102. In some examples, the socket opening 400 receives the socket fitting 203 (shown in FIG. 2) and the socket fitting 203 is coupled with the fenestration frame 102 with the socket fitting 203 received in the socket opening 400 of the fenestration frame 102.

Referring again to FIG. 4A, the fenestration assembly 100 includes the sash latch operator 106 and a latch fastener 406. The latch fastener 406 is coupled to the sash frame 120, and the latch fastener 406 projects from the sash 104 toward the interior face 124 of the fenestration assembly 100. The sash latch operator 106 cooperates with the latch fastener 406 to secure the sash 104 in the closed position. For example, the sash latch operator 106 includes a latch blade that engages with the latch fastener 406 to inhibit movement of the sash 104 from the closed position to the open position.

As described herein, the fenestration assembly 100 includes the screen assembly 300. In some examples, includes a hinge 403 facilitates movement of the screen assembly (e.g., from the closed position to the open position). Optionally, the screen assembly 300 includes one or more opposed latches (e.g., on a side opposite to the screen latch 304) that facilitate decoupling of the screen assembly 300 from the fenestration frame 102 (e.g., for cleaning, maintenance, storage, or the like). In another example, the screen assembly 300 is coupled to the fenestration frame 102 by seating the screen assembly 300 in a groove. In yet another example, a bracket couples the screen assembly 300 to the fenestration frame 102. Accordingly, in this example the screen latch 304 is only needed to secure the screen assembly in the closed position.

Figure 4B:
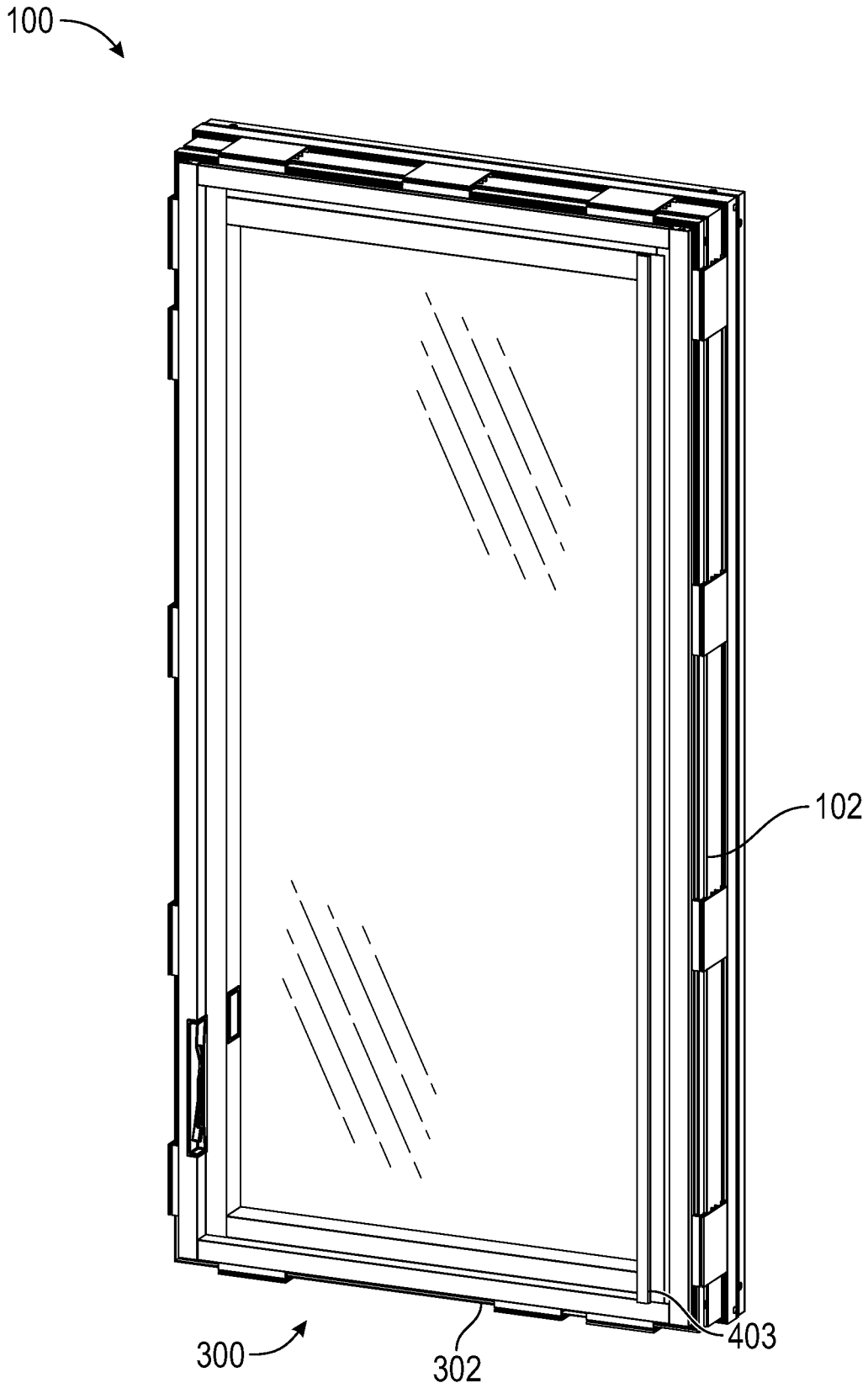
FIG. 4B is perspective view of the fenestration assembly of FIG. 4A in an assembled configuration.

FIG. 4B is perspective view of the fenestration assembly of FIG. 4A in an assembled configuration. As described herein, the screen assembly 300 is moveable between an open position (shown in FIG. 9B) and a closed position (shown in FIG. 3). For instance, the hinge 403 facilitates movement of the screen frame 302 relative to the fenestration frame 102. The screen frame 302 conceals the sash handle assembly 114 (shown in FIG. 3) with the screen assembly 300 is in the closed position.

Figure 4C:
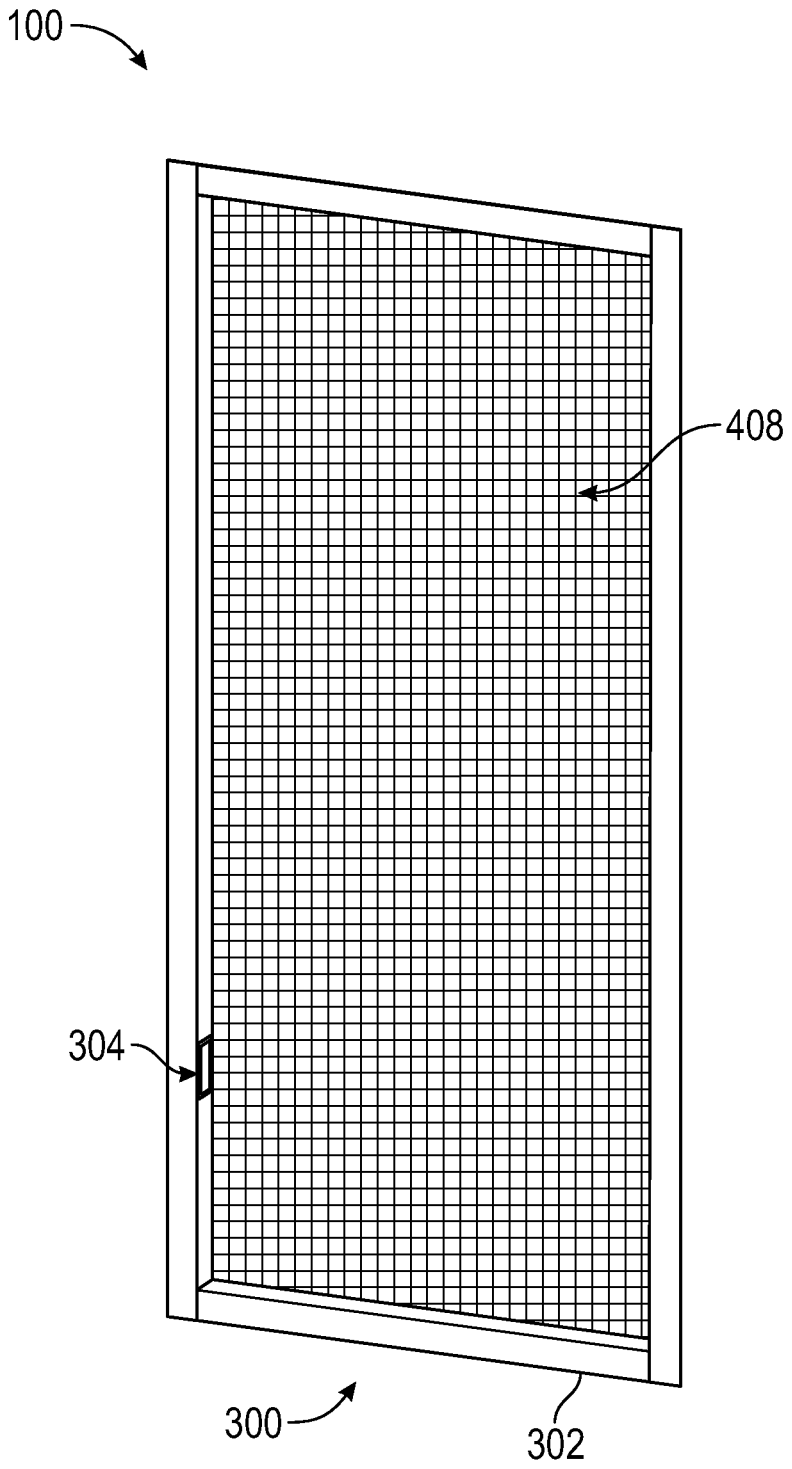
FIG. 4C is a perspective view of the screen assembly of FIG. 3 including a screen membrane.

FIG. 4C is a perspective view of the screen assembly 300 of FIG. 3 including a screen membrane 408. The screen membrane 408 spans the screen frame 302 of the screen assembly 300. The screen membrane 408 inhibits debris, insects, or the like from passing through (e.g., entering, exiting, or the like) the fenestration assembly 100. The screen assembly 300 is optionally separable from the fenestration frame 102 (shown in FIG. 5B) to facilitate cleaning, maintenance, or storage the screen assembly 300. FIG. 4C shows the screen frame 302 including the screen membrane 408. In some examples, for instance in FIGS. 3, 4A, and 4B the screen assembly 300 is shown without the screen membrane 408 for clarity in displaying other components of the fenestration assembly 100.

Figure 5A:
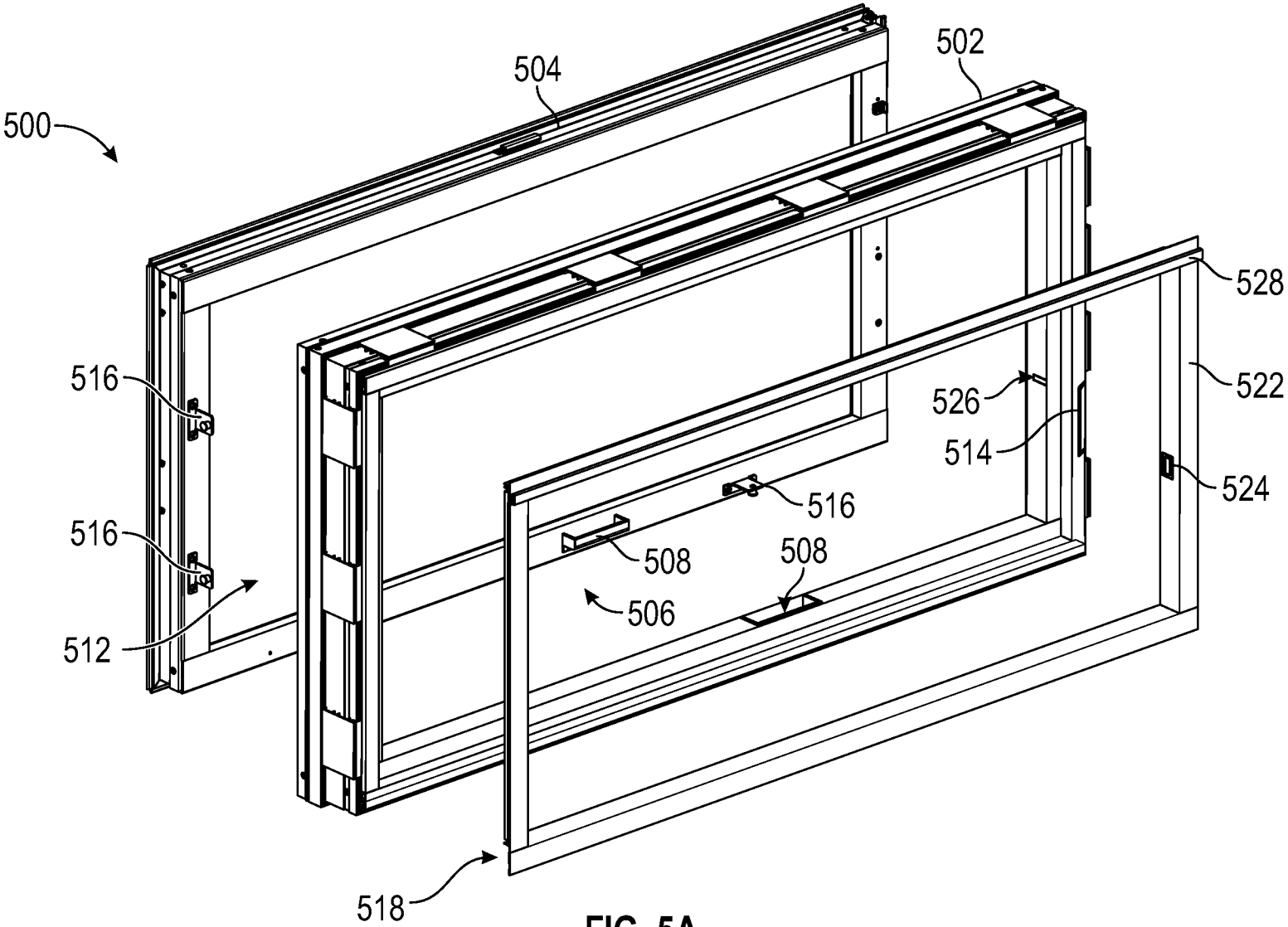
FIG. 5A is an exploded view of another example of a fenestration assembly including another example of a sash handle assembly and another example of a screen assembly.

FIG. 5A is an exploded view of another example of a fenestration assembly 500 (e.g., an awning window, or the like) including another example of a sash handle assembly 506. For example, the fenestration assembly 500 includes a fenestration frame 502 and a sash 504 (e.g., a casement sash, awning sash, venting picture sash, door, or the like) movably coupled with the fenestration frame 502. The fenestration assembly 500 includes the sash handle assembly 506, and the sash handle assembly 506 facilitates movement of the sash 504 relative to the fenestration frame 502 (e.g., between an open position and a closed position).

In an example, the sash handle assembly 506 includes a sash handle 508 and a handle socket 510. The sash handle 508 provides a grip (e.g., hand-hold, arm, or the like) for operation of a panel (e.g., the sash 104, or the like). The handle socket 510 receives the sash handle 508, for instance with the sash 504 in the closed position. The sash handle assembly 506 is concealed, and a daylight opening 512 of the fenestration assembly 500 is unobstructed by at least the sash handle assembly 506.

The fenestration assembly 500 optionally includes a sash latch operator 514 that facilitates securing the sash 504 in the closed position. In an example, manipulation of the sash latch operator 514 engages with a latch fastener 516 to inhibit movement of the sash 504 relative to the fenestration frame 502 (or disengages the latch operator 514 from the latch fastener 516 to facilitate movement of the sash 504 relative to the fenestration frame 502). Accordingly, the sash latch operator facilitates transitioning the sash 104 between a locked configuration and an unlocked configuration.

Referring again to FIG. 5A, the fenestration assembly 500 includes a screen assembly 518, and the screen assembly 518 is coupled with the fenestration frame 502. The screen assembly 518 conceals the sash latch operator 514, for example with the sash handle 508 received in the handle socket 510. The screen assembly 518 includes a screen latch 524, and the screen latch 524 cooperates with an anchor 526 to secure the screen in a closed position.

In an example, the screen assembly 518 includes a hinge 528 that facilitates movement of a screen frame 522 relative to the fenestration frame 102. In another example, the screen assembly 518 includes a latch, bracket, bayonet, or the like that facilitates decoupling the screen assembly from the fenestration frame 102. For instance, the screen frame 522 is separable from the fenestration frame 102 to facilitate cleaning, maintenance, or storage the screen assembly 518.

Figure 5B:
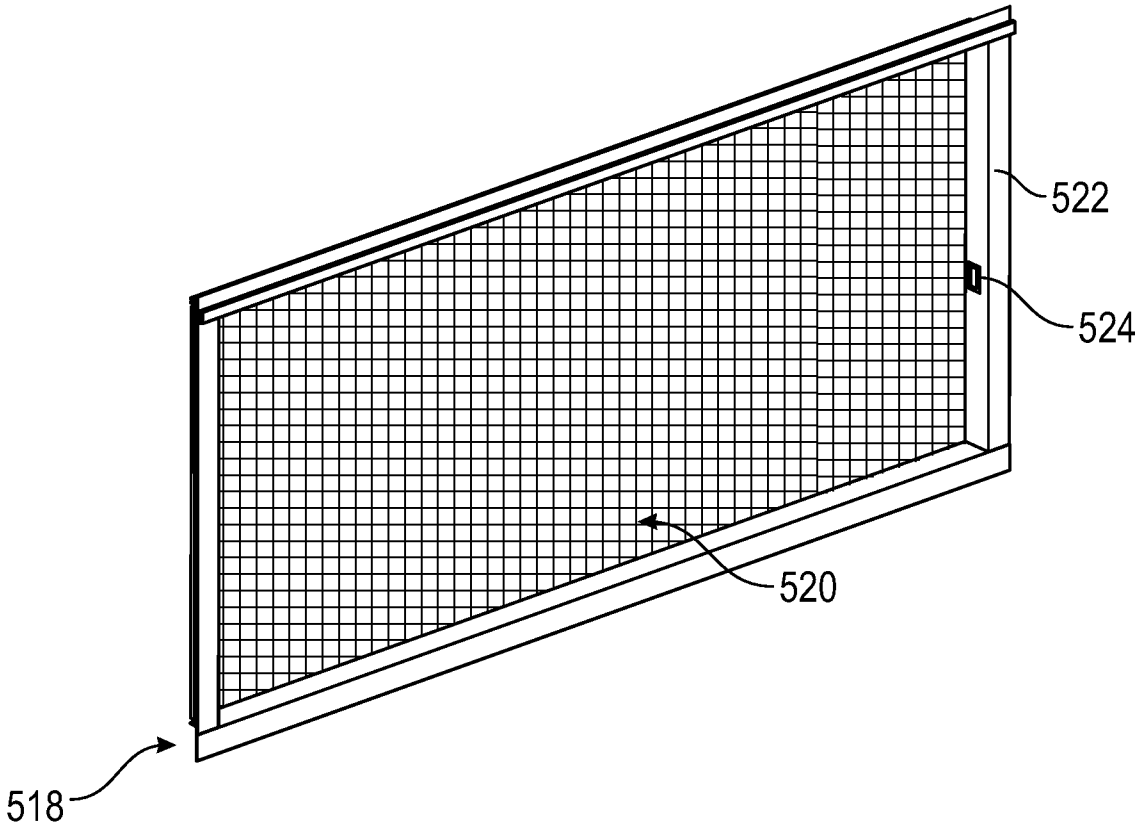
FIG. 5B is a perspective view of the screen assembly of FIG. 5A including another example of a screen membrane

FIG. 5B is a perspective view of the screen assembly 518 of FIG. 5A including another example of a screen membrane 520. The screen assembly 518 includes a screen membrane 520 spanning the screen frame 522 of the screen assembly 518. The screen membrane 520 inhibits debris, insects, or the like from passing through (e.g., entering, exiting, or the like) the fenestration assembly 500, for example with the sash 504 in the open position. FIG. 5B shows the screen frame 522 including the screen membrane 408. In some examples, for instance in FIG. 5A, the screen assembly 518 is shown without the screen membrane 520 for clarity in displaying other components of the fenestration assembly 500.

Figure 6A:
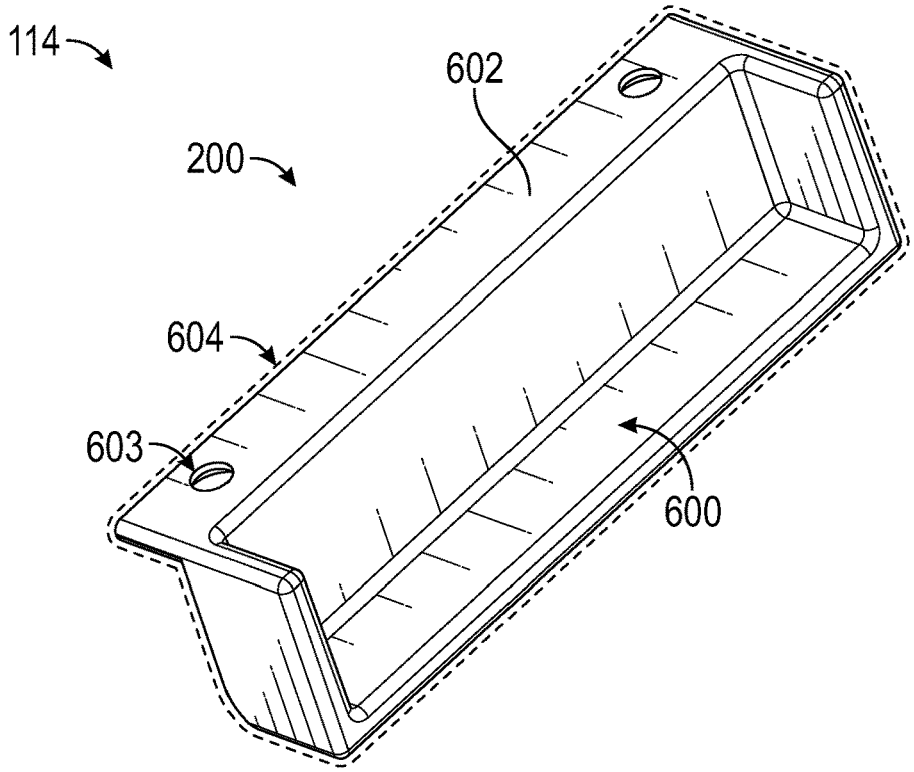
FIG. 6A is a perspective view of one example of a sash handle.
Figure 6B:
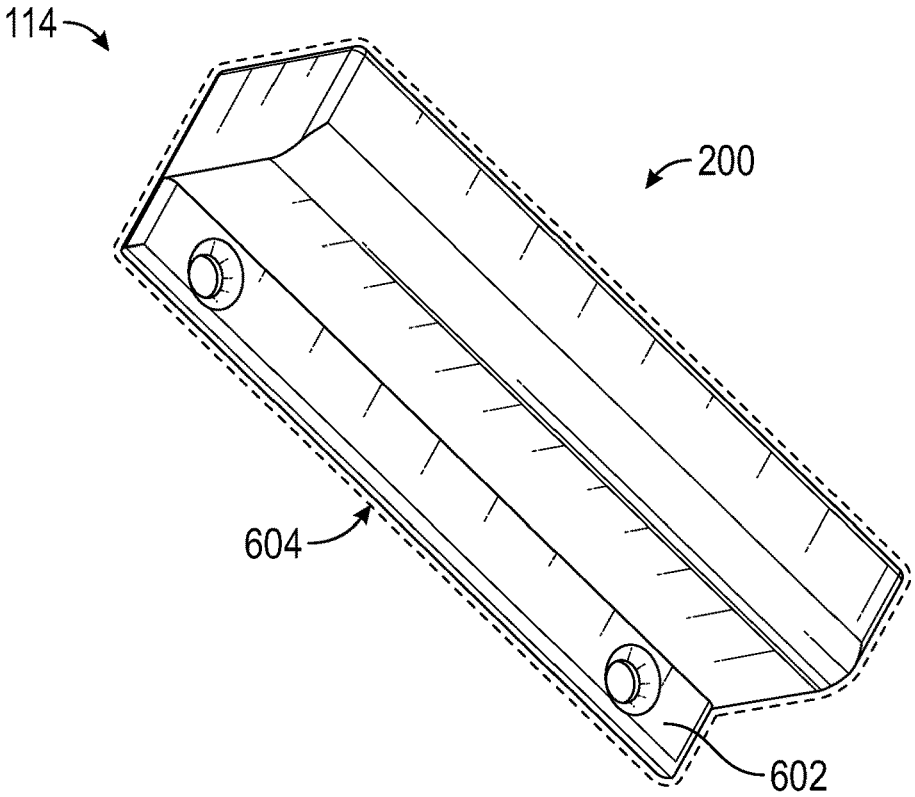
FIG. 6B is another perspective view of the sash handle of FIG. 6A.

FIGS. 6A and 6B are perspective views of one example of the sash handle 200. As described herein, the sash handle 200 is included in the sash handle assembly 114. The sash handle 200 includes a grip surface 600 that facilitates a user manipulating (e.g., grabbing, grasping, holding, pulling, pushing, or the like) the sash handle 200 to move the sash 104 relative to the fenestration frame 102 (shown in FIG. 1). The grip surface 600 is accessible with the sash handle 200 received in the handle socket 202 (shown in FIG. 2). For example, the sash handle 200 including the grip surface 600 opens toward the inner perimeter 126 of the fenestration assembly 100 (shown in FIG. 1) to facilitate access to the sash handle 200.

The sash handle 200 optionally includes a fastening flange 602 that facilitates coupling the sash handle 200 with components of the fenestration assembly 100, for instance the sash 104. One or more through-holes 603 optionally extend through the fastening flange 602, for instance to allow a fastener (e.g., screw, rivet, bolt, or the like) to secure the fastening flange 602 to the sash 104.

The sash handle 200 includes a handle profile 604. The handle profile 604 includes one or more of a footprint, cross-section, shape, size, dimension, contour, radius, perimeter, circumference, outline, boundary, configuration, pattern, arrangement, thickness or the like of the sash handle 200. In some examples, the handle profile 604 is included in the composite handle profile 206 (shown in FIG. 2).

Figure 7A:
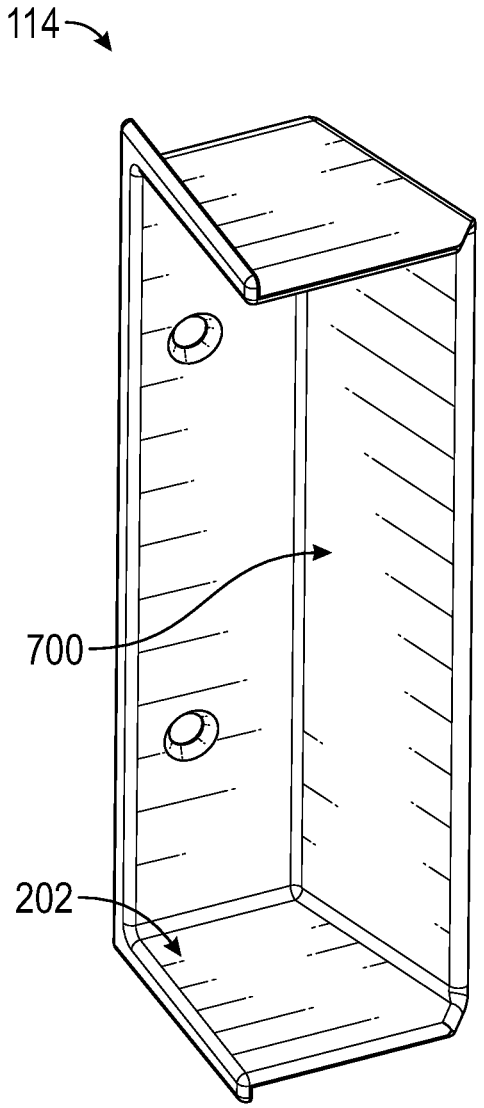
FIG. 7A is a perspective view of one example of a handle socket.
Figure 7B:
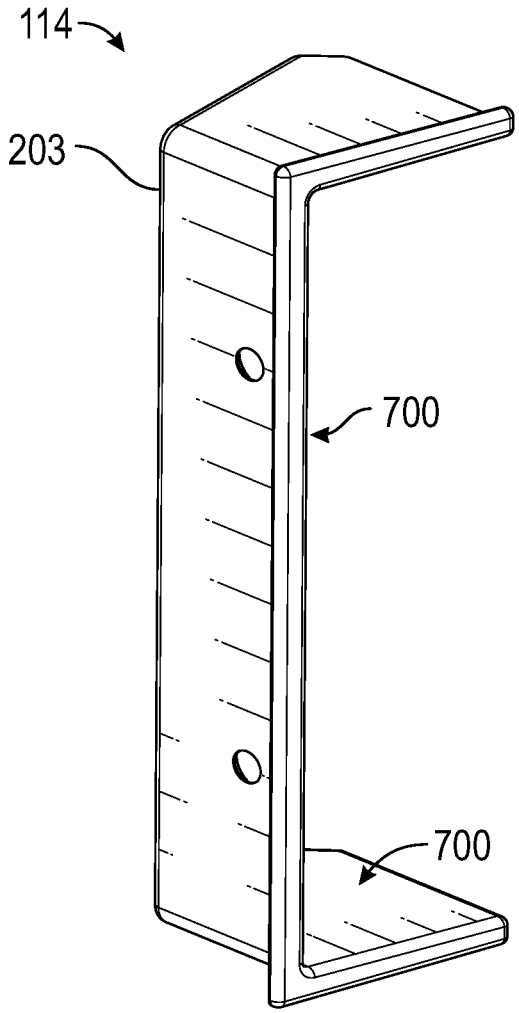
FIG. 7B is another perspective view of the handle socket of FIG. 7A.

FIG. 7A and FIG. 7B are perspective views of an example handle socket 202. The handle socket 202 includes the socket fitting 203, and the handle socket 202 includes a socket profile 700. The socket profile 700 includes one or more of a footprint, cross-section, shape, size, dimension, contour, radius, perimeter, circumference, outline, boundary, configuration, pattern, arrangement, thickness or the like of the handle socket 202.

In an example, composite profile 206 (shown in FIG. 2) of the sash handle assembly 114 includes the handle profile 604 (shown in FIGS. 6A and 6B) and the socket profile 700. The handle profile 604 is complementary to the socket profile 700, and accordingly the complementary profiles 604, 700 (and composite handle profile 206) allows the handle socket 202 to receive the sash handle 200. For instance, the handle socket 202 receives the sash handle 200 when the sash 104 is in the closed position (shown in FIG. 2).

Figure 8A:
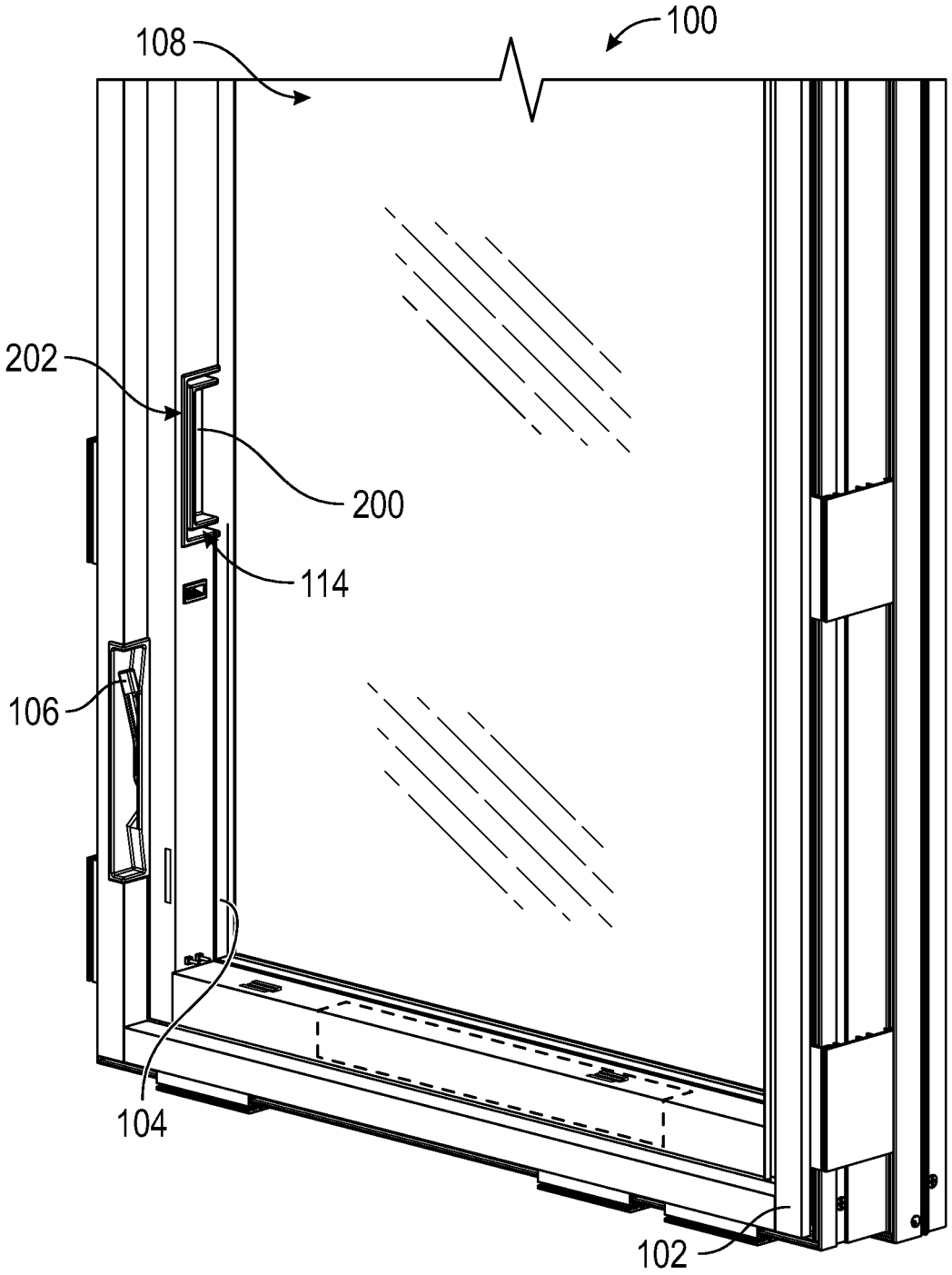
FIG. 8A is a detailed perspective view of the fenestration assembly of FIG. 1 in a closed position.

FIG. 8A is a detailed perspective view of the fenestration assembly 100 (e.g., the sash 104) of FIG. 1 in a closed position. With the sash 104 in the closed position, the sash handle 200 is received in the handle socket 202. The sash handle 200 provides a grip (e.g., grip surface 600, shown in FIG. 6A) to facilitate movement of the sash 104 relative to the fenestration frame 102. As shown in FIG. 8A, the sash handle 200 is accessible with the sash 104 in the closed position, and the sash handle 200 is located outside of the daylight opening 108 (and correspondingly the daylight opening 108 is unobstructed by the sash handle assembly 114). The sash latch operator 106 facilitates securing the sash 104 in the closed position (e.g., by inhibiting movement of the sash 104 relative to the fenestration frame 102). In FIG. 8A the sash latch operator 106 is in an unlocked position and the sash 104 is ready for opening.

Figure 8B:
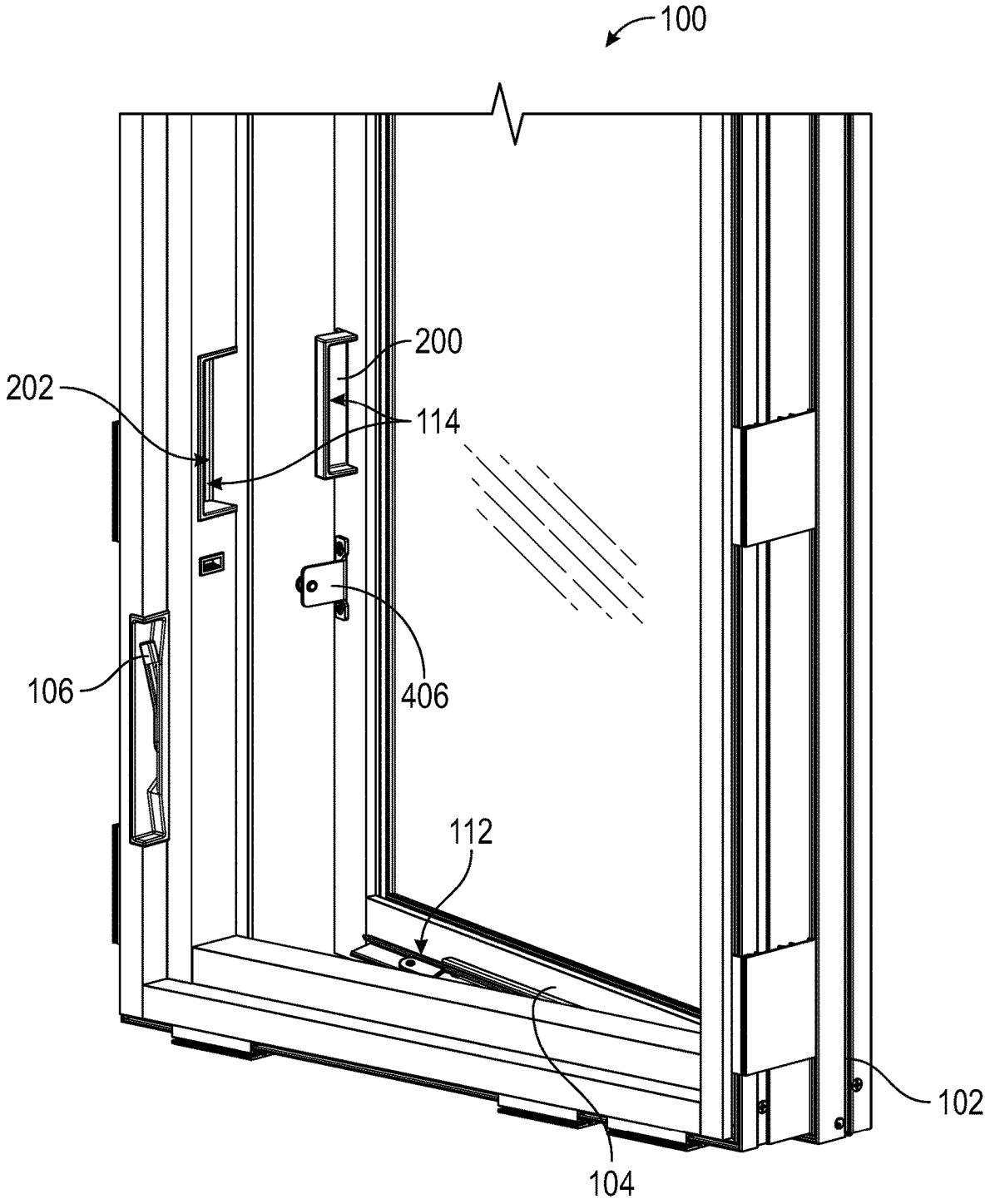
FIG. 8B is a detailed perspective view of the fenestration assembly of FIG. 1 in an open position.

FIG. 8B is a detailed perspective view of the fenestration assembly 100 (e.g., the sash 104) of FIG. 1 in an open position. As described herein, the sash 104 is movable between open and closed positions. For example, the latch operator 106 is manipulated to transition the latch operator 106 between a locked configuration (e.g., with the sash 104 secured in the closed position) and an unlocked configuration (e.g., allowing movement of the sash 104 relative to the fenestration frame 102). The sash operating mechanism 112 (e.g., hinges, linkage, mechanism, or the like) guides movement of the sash 104 relative to the fenestration frame 102 and supports the sash 104 when moved relative to the fenestration frame 102. In one example, the sash handle 200 is manipulated by the user to open the sash 104, for instance by grasping the sash handle 200 and applying force at the sash handle 200 to move the handle out of the handle socket 202 and correspondingly move the sash 104.

As shown in FIG. 8B, with the sash 104 in the open position, the sash handle 200 is decoupled (e.g., unseated, separated, or like) from the handle socket 202. For example, manual operation of the fenestration assembly moves the sash handle 200 from the socket 202 as part of opening the sash 104. The handle socket 202 opens toward the exterior face 122 of the fenestration frame 102, and the sash handle 200 moves toward the exterior and out of the handle socket 202. In an example with the sash 104 in the open position, the sash handle 200 is spaced from the handle socket 202 according to the position of the sash 104 relative to the fenestration frame 102. In another example, the latch fastener 406 is spaced from the sash latch operator 106 according to the position of the sash 104 relative to the fenestration frame 102. In yet another example, the sash handle 200 is spaced from the screen frame 302 with the sash 104 in the open position (e.g., when the screen assembly 300, shown in FIG. 3, is in the closed position and the sash 104 is in the open position).

Figure 9A:
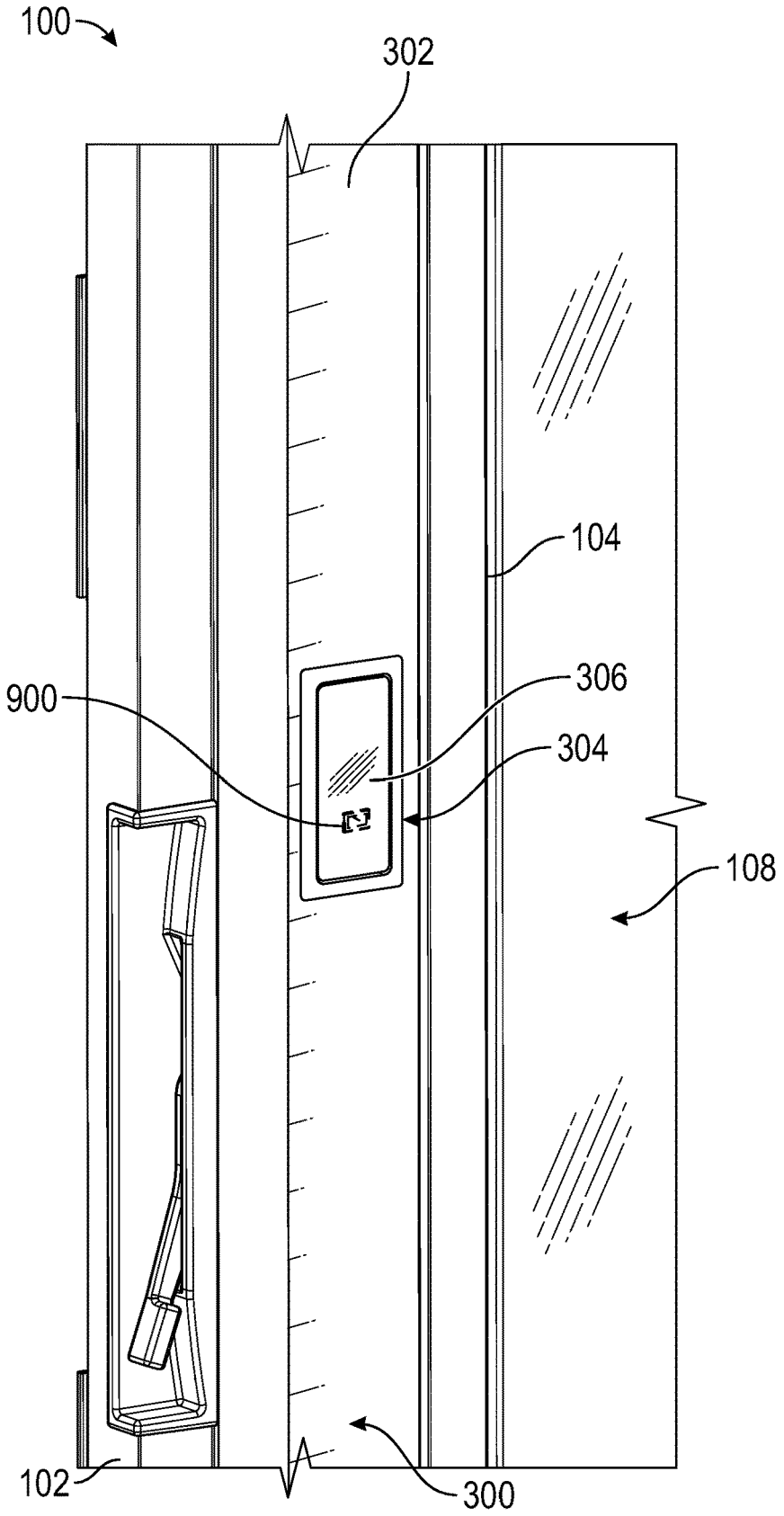
FIG. 9A is a detailed perspective view of the fenestration assembly of FIG. 3 with the screen assembly in a closed position.

FIG. 9A is a detailed perspective view of the fenestration assembly 100 of FIG. 3 with the screen assembly 300 in the closed position. FIG. 9A shows the screen frame 302 blending with one or more of the sash 104 or the fenestration frame 102 to minimize the profile of the screen assembly 300 relative to the fenestration assembly 100. For example, the screen frame 302 masks gaps between the screen frame and the fenestration frame 102 or sash 104.

In some examples, the screen latch 304 (e.g., the latch rocker 306) is flush with the screen frame 302 to locate the screen latch 304 outside of the daylight opening 108 of the fenestration assembly 100. In some examples, the screen assembly 300 conceals the sash handle assembly 114 with screen assembly 300 in the closed position.

As described herein, the screen latch 304 secures the screen assembly 300 in the closed position. For instance, the screen latch 304 includes a latch anchor 900 (shown in broken lines) that engages with the anchor socket 204 (shown in FIG. 9B) to secure the screen assembly 300 in the closed position. In an example, operation of the latch rocker 306 (e.g., by a user depressing the latch rocker 306) disengages the latch anchor 900 from the anchor socket 204 to allow the screen assembly 300 to move relative to the fenestration frame 102 (e.g., toward the open position).

Figure 9B:
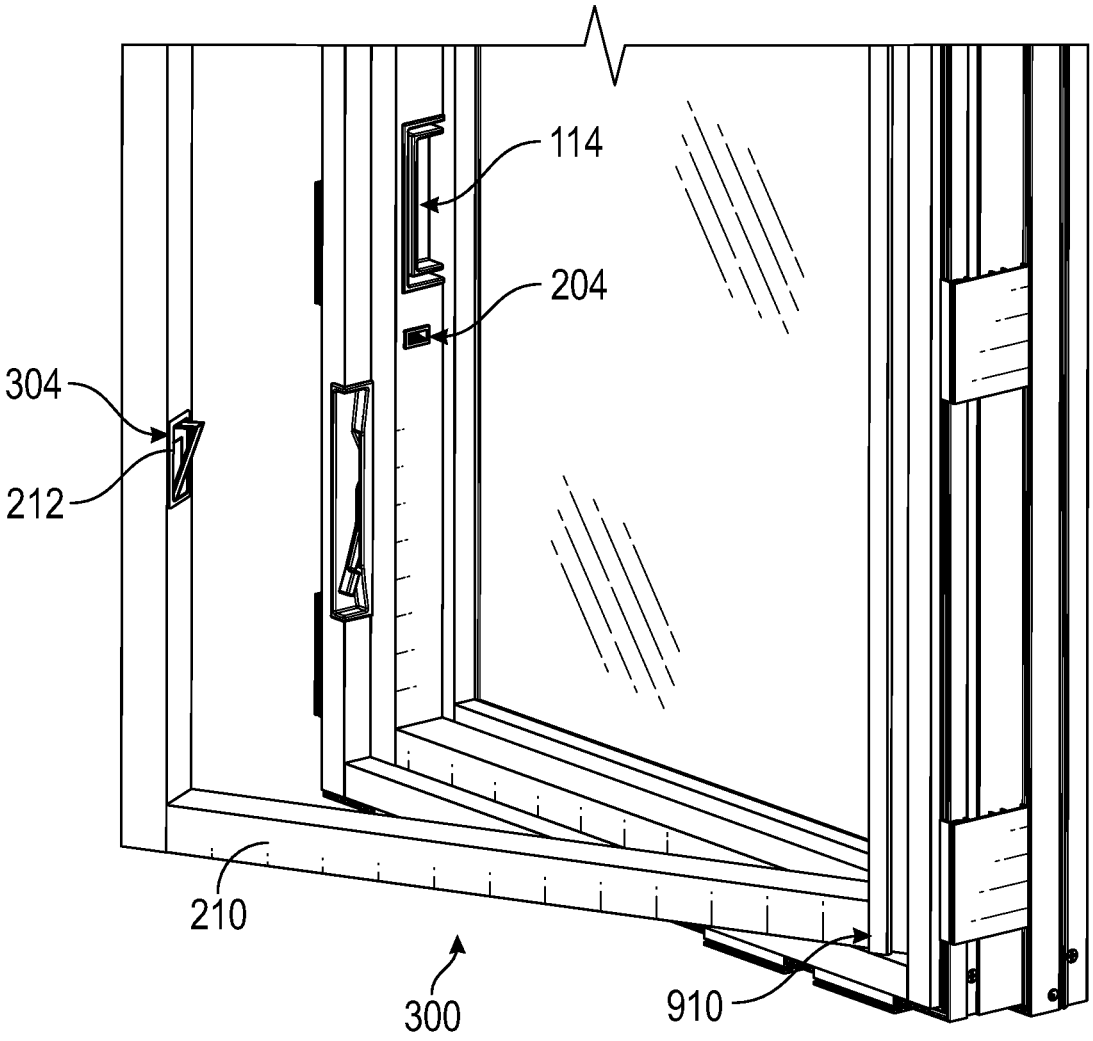
FIG. 9B is a detailed perspective view of the fenestration assembly of FIG. 3 with the screen assembly in an open position.

FIG. 9B is a detailed perspective view of the fenestration assembly 100 of FIG. 3 with the screen assembly 300 in the open position. In an example, the screen assembly 100 is movably coupled to the fenestration frame 102 with a hinge 910. For instance, the screen latch 304 is operated, and the screen assembly 300 is rotated relative to the fenestration frame 102 to move between the closed position shown in FIG. 9A and the open position shown in FIG. 9B.

As described herein, the latch rocker 306 is operated to facilitate transitioning the screen latch 304 between a locked configuration and an unlocked configuration. In an example with the screen assembly 300 in the closed position (e.g., with the screen frame 302 rotated into a closed position with respect to the fenestration frame 102), the latch anchor 900 (shown in FIG. 9A) of the screen latch 304 engages with the anchor socket 204 of the fenestration frame 102 to secure the screen assembly 300 in the closed position. For instance, the latch anchor 900 is a plug, flange or the like received in the socket 204). Manipulation of the latch rocker 306 (e.g., by a user, electromechanical actuator, or the like) disengages the latch anchor 900 from the anchor socket 204 and releases the screen assembly 300 for movement to the open position (shown in FIG. 9B) from the closed position (shown in FIG. 9A). Movement of the screen assembly 300 facilitates access to at least the sash handle assembly 114 (in example embodiments including the screen frame 302 concealing portions of the fenestration assembly 100, for instance the sash handle assembly 114).

Figure 10:
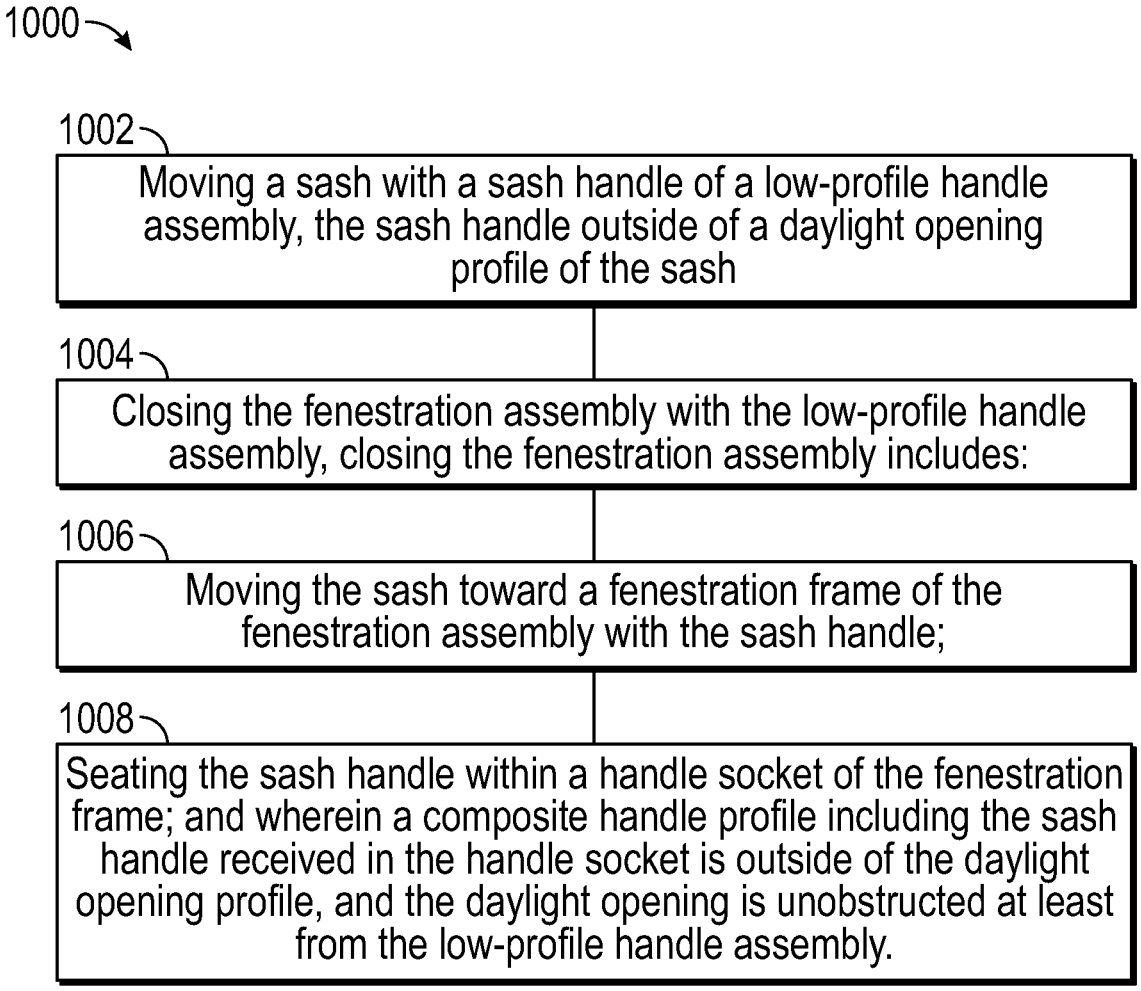
FIG. 10 shows one example of a method for operating a fenestration assembly.

FIG. 10 shows one example of a method 1000 for operating a fenestration assembly, including one or more of the fenestration assembly 100 described herein. In describing the method 1000, reference is made to one or more components, features, functions and operations previously described herein. Where convenient, reference is made to the components, features, operations and the like with reference numerals. The reference numerals provided are exemplary and are not exclusive. For instance, components, features, functions, operations and the like described in the method 1000 include, but are not limited to, the corresponding numbered elements provided herein and other corresponding elements described herein (both numbered and unnumbered) as well as their equivalents.

At 1002, the method 1000 includes moving a sash 104 with a sash handle 200 of a low profile handle assembly 114. In an example, moving the sash 104 includes pulling the sash 104 with the sash handle 200. In another example, moving the sash 104 includes manually pushing or pulling the sash 104 with the sash handle 200. In an example, the sash handle 200 is outside of a daylight opening profile 116 of the sash 104, for instance to provide an unobstructed daylight opening 108.

At 1004, the fenestration assembly 100 is closed, for example with the low profile handle assembly 114. Closing the fenestration assembly 100 includes at 1006 that the sash 104 is moved toward a fenestration frame 102 of the fenestration assembly 100. At 1008 closing the fenestration assembly 100 includes seating the sash handle 200 within a handle socket 202 of the fenestration frame 102.

In an example, the handle socket 202 receives the sash handle 200 when the sash 104 is moved to the closed position. For instance, the sash handle 200 includes a handle profile 604 complementary to a socket profile 700 of the handle socket 202. Seating the sash handle 200 within the handle socket includes seating the complementary handle profile 604 within the socket profile 700. Accordingly, the handle socket 202 and the sash handle 200 are included in a composite handle profile 206. The composite handle profile 206 is outside the daylight opening profile 116 (e.g., when the sash handle 200 is received in the handle socket 202). As a result, the daylight opening 108 is unobstructed at least from the low profile handle assembly 114 (e.g., the daylight opening 108 is optionally unobstructed by a sash latch operator 106 or a screen assembly 300).

Several options for the method 1000 follow. For example, the low profile handle assembly 114 is concealed. Optionally, the low profile handle assembly 114 is recessed into one or more of the fenestration frame 102 or a sash frame 120 of the sash 104.

In another example, the method 1000 includes concealing the low profile handle assembly 114, for instance by coupling a screen frame 302 of the screen assembly 300 along the fenestration frame 102 (e.g., with a hinge 910). Optionally, each of the handle socket 202 and the sash handle 200 are covered with the screen frame 302 with the sash 104 in a closed position.

The method 1000 optionally includes opening the fenestration assembly 100. For example, the sash 104 is moved away from the fenestration frame 102 (e.g., to an open position). Movement of the sash 104 away from the fenestration frame 102 unseats the sash handle 200 from the handle socket 202. Accordingly, movement of the sash 104 transitions the sash 104 between a closed position and an open position.

VARIOUS NOTES AND ASPECTS

Aspect 1 can include subject matter such as a fenestration assembly including a low profile handle comprising: a fenestration frame; a sash movably coupled with the fenestration frame, the sash includes a daylight opening having a daylight opening profile; and a low profile handle assembly coupled with the fenestration frame and the sash, the low profile handle assembly includes: a sash handle coupled with the sash; a handle socket in the fenestration frame, the handle socket configured for reception of the sash handle; and a composite handle profile including the sash handle received in the handle socket, and the composite handle profile is outside of the daylight opening profile, and the daylight opening is unobstructed at least from the low profile handle assembly.

Aspect 2 can include, or can optionally be combined with the subject matter of Aspect 1, to optionally include wherein handle socket includes a socket fitting in the fenestration frame.

Aspect 3 can include, or can optionally be combined with the subject matter of one or any combination of Aspects 1 or 2 to optionally include wherein the socket fitting is flush with the fenestration frame.

Aspect 4 can include, or can optionally be combined with the subject matter of one or any combination of Aspects 1-3 to optionally include wherein the handle socket includes an opening directed toward an exterior face of the fenestration assembly.

Aspect 5 can include, or can optionally be combined with the subject matter of one or any combination of Aspects 1-4 to optionally include wherein the handle socket includes the opening directed toward the exterior face and the inner perimeter of the fenestration assembly.

Aspect 6 can include, or can optionally be combined with the subject matter of Aspects 1-5 to optionally include wherein the sash handle includes a handle profile and the handle socket includes a socket profile complementary to the handle profile of the sash handle.

Aspect 7 can include, or can optionally be combined with the subject matter of Aspects 1-6 to optionally include wherein the sash handle projects from the sash toward an interior face of the fenestration assembly.

Aspect 8 can include, or can optionally be combined with the subject matter of Aspects 1-7 to optionally include wherein the sash handle includes a grip surface, and the grip surface is accessible with the sash handle received in the handle socket.

Aspect 9 can include, or can optionally be combined with the subject matter of Aspects 1-8 to optionally include wherein sash is movable between open and closed positions: in the open position the sash handle is spaced from the handle socket according to the position of the sash relative to the fenestration frame; and in the closed position the sash handle is received in the handle socket.

Aspect 10 can include, or can optionally be combined with the subject matter of Aspects 1-9 to optionally include wherein the composite handle profile is flush with the fenestration frame with the sash in the closed position.

Aspect 11 can include, or can optionally be combined with the subject matter of Aspects 1-10 to optionally include a fenestration assembly including a low profile handle comprising: a fenestration frame; a sash movably coupled with the fenestration frame, the sash includes a daylight opening having a daylight opening profile, wherein the sash is movable between open and closed positions; a low profile handle assembly coupled with the fenestration frame and the sash, the low profile handle assembly includes: a sash handle coupled with the sash; and a handle socket in the fenestration frame, the handle socket configured for reception of the sash handle; a low profile screen assembly coupled with the fenestration frame, the low profile screen assembly includes a screen frame having a screen frame profile and a screen membrane spanning the screen frame; and wherein the screen frame profile and a composite handle profile of the low profile handle assembly are outside of the daylight opening profile, and the daylight opening is unobstructed by the low profile handle assembly and the screen frame profile.

Aspect 12 can include, or can optionally be combined with the subject matter of Aspects 1-11 to optionally include wherein handle socket includes a socket fitting in the fenestration frame.

Aspect 13 can include, or can optionally be combined with the subject matter of Aspects 1-12 to optionally include wherein the handle socket includes an opening directed toward an exterior face of the fenestration assembly.

Aspect 14 can include, or can optionally be combined with the subject matter of Aspects 1-13 to optionally include wherein the handle socket includes the opening directed toward the exterior face and the inner perimeter of the fenestration assembly.

Aspect 15 can include, or can optionally be combined with the subject matter of Aspects 1-14 to optionally include wherein the sash handle includes a handle profile and the handle socket includes a socket profile complementary to the sash handle.

Aspect 16 can include, or can optionally be combined with the subject matter of Aspects 1-15 to optionally include wherein the sash handle includes a grip surface, and the grip surface is accessible with the sash handle received in the handle socket.

Aspect 17 can include, or can optionally be combined with the subject matter of Aspects 1-16 to optionally include wherein the screen frame covers the low profile handle assembly in the closed position.

Aspect 18 can include, or can optionally be combined with the subject matter of Aspects 1-17 to optionally include wherein the screen frame conceals the low profile handle assembly in the closed position.

Aspect 19 can include, or can optionally be combined with the subject matter of Aspects 1-18 to optionally include wherein the sash handle is spaced from the handle socket and the screen frame in the open position.

Aspect 20 can include, or can optionally be combined with the subject matter of Aspects 1-19 to optionally include wherein the composite handle profile is flush with the fenestration frame with the sash in the closed position.

Aspect 21 can include, or can optionally be combined with the subject matter of Aspects 1-20 to optionally include a method for operating a fenestration assembly comprising: moving a sash with a sash handle of a low profile handle assembly, the sash handle outside of a daylight opening profile of the sash; closing the fenestration assembly with the low profile handle assembly, closing the fenestration assembly includes: moving the sash toward a fenestration frame of the fenestration assembly with the sash handle; seating the sash handle within a handle socket of the fenestration frame; and wherein a composite handle profile including the sash handle received in the handle socket is outside of the daylight opening profile, and the daylight opening is unobstructed at least from the low profile handle assembly.

Aspect 22 can include, or can optionally be combined with the subject matter of Aspects 1-21 to optionally include wherein moving the sash includes manually pushing or pulling the sash with the sash handle.

Aspect 23 can include, or can optionally be combined with the subject matter of Aspects 1-22 to optionally include wherein moving the sash includes pulling the sash with the sash handle.

Aspect 24 can include, or can optionally be combined with the subject matter of Aspects 1-23 to optionally include wherein the sash handle includes a handle profile complementary to a socket profile of the handle socket, and seating the sash handle within the handle socket includes seating the complementary handle profile within the socket profile.

Aspect 25 can include, or can optionally be combined with the subject matter of Aspects 1-24 to optionally include concealing the low profile handle assembly, concealing includes: recessing the low profile handle assembly into one or more of the fenestration frame or a sash frame of the sash.

Aspect 26 can include, or can optionally be combined with the subject matter of Aspects 1-25 to optionally include concealing the low profile handle assembly, concealing includes: coupling a screen frame of a screen assembly along the fenestration frame; and covering each of the handle socket and the sash handle with the screen frame with the sash in a closed position.

Aspect 27 can include, or can optionally be combined with the subject matter of Aspects 1-26 to optionally include opening the fenestration assembly, opening the fenestration assembly includes: moving the sash away from the fenestration frame; and unseating the sash handle from the handle socket.

Each of these non-limiting aspects can stand on its own, or can be combined in various permutations or combinations with one or more of the other aspects.

The above description includes references to the accompanying drawings, which form a part of the detailed description. The drawings show, by way of illustration, specific embodiments in which the invention can be practiced. These embodiments are also referred to herein as "aspects" or "examples." Such aspects or example can include elements in addition to those shown or described. However, the present inventors also contemplate aspects or examples in which only those elements shown or described are provided. Moreover, the present inventors also contemplate aspects or examples using any combination or permutation of those elements shown or described (or one or more features thereof), either with respect to a particular aspects or examples (or one or more features thereof), or with respect to other Aspects (or one or more features thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Geometric terms, such as "parallel", "perpendicular", "round", or "square", are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

The above description is intended to be illustrative, and not restrictive. For example, the above-described aspects or examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as aspects, examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A fenestration assembly including a low profile handle comprising:

a fenestration frame;

a sash movably coupled with the fenestration frame between an open position, a closed position and intermediate positions therebetween, the sash includes a daylight opening having a daylight opening profile; and a low profile handle assembly coupled with the fenestration frame and the sash, the low profile handle assembly includes:

a sash handle coupled with the sash;

a handle socket in the fenestration frame, the handle socket configured for reception of the sash handle, wherein the handle socket communicates with the daylight opening;

a composite handle profile including the sash handle received in the handle socket with the sash in the closed position and the handle accessible from the daylight opening, and the composite handle profile is outside of the daylight opening profile, and the daylight opening is unobstructed at least from the low profile handle assembly; and wherein the sash handle is decoupled from the handle socket and the fenestration frame in the intermediate and open positions.

2. The fenestration assembly of claim 1, wherein the handle socket includes a socket fitting in the fenestration frame.

3. The fenestration assembly of claim 2, wherein the socket fitting is flush with the fenestration frame.

4. The fenestration assembly of claim 1, wherein the handle socket includes an opening directed toward an exterior face of the fenestration assembly.

5. The fenestration assembly of claim 3, wherein the handle socket includes the opening directed toward the exterior face of the fenestration assembly and an inner perimeter of the fenestration assembly.

6. The fenestration assembly of claim 1, wherein the sash handle includes a handle profile and the handle socket includes a socket profile complementary to the handle profile of the sash handle.

7. The fenestration assembly of claim 1, wherein the sash handle projects from the sash toward an interior face of the fenestration assembly.

8. The fenestration assembly of claim 1, wherein the sash handle includes a grip surface, and the grip surface is accessible from an inner perimeter of the fenestration assembly with the sash in the closed position.

9. The fenestration assembly of claim 1, wherein the sash is movable between open and closed positions:

in the open position the sash handle is spaced from the handle socket according to the position of the sash relative to the fenestration frame; and in the closed position the sash handle is received in the handle socket.

10. The fenestration assembly of claim 9, wherein the composite handle profile is flush with the fenestration frame with the sash in the closed position.

11. A fenestration assembly including a low profile handle comprising:

a fenestration frame;

a sash movably coupled with the fenestration frame between an open position, a closed position and intermediate positions therebetween, the sash includes a daylight opening having a daylight opening profile, wherein the sash is movable between open and closed positions;

a low profile handle assembly coupled with the fenestration frame and the sash, the low profile handle assembly includes:

a sash handle coupled with the sash;

a handle socket in the fenestration frame, the handle socket configured for reception of the sash handle with the sash in the closed position, wherein the sash handle is decoupled from the handle socket and the fenestration frame in the intermediate and open positions; and wherein the handle socket comprises an opening exposed to the daylight opening of the fenestration assembly and the sash handle is reachable through the daylight opening;

a low profile screen assembly coupled with the fenestration frame, the low profile screen assembly includes a screen frame having a screen frame profile and a screen membrane spanning the screen frame; and wherein the screen frame profile and a composite handle profile of the low profile handle assembly are outside of the daylight opening profile, and the daylight opening is unobstructed by the low profile handle assembly and the screen frame profile.

12. The fenestration assembly of claim 11, wherein handle socket includes a socket fitting in the fenestration frame.

13. The fenestration assembly of claim 11, wherein the handle socket includes an opening directed toward an exterior face of the fenestration assembly.

14. The fenestration assembly of claim 13, wherein the handle socket includes the opening directed toward the exterior face and an inner perimeter of the fenestration assembly.

15. The fenestration assembly of claim 11, wherein the sash handle includes a handle profile and the handle socket includes a socket profile complementary to the sash handle.

16. The fenestration assembly of claim 11, wherein the sash handle includes a grip surface, and the grip surface is accessible with the sash handle received in the handle socket.

17. The fenestration assembly of claim 11, wherein the screen frame covers the low profile handle assembly in the closed position.

18. The fenestration assembly of claim 11, wherein the screen frame conceals the low profile handle assembly in the closed position.

19. The fenestration assembly of claim 11, wherein the sash handle is spaced from the handle socket and the screen frame in the open position.

20. The fenestration assembly of claim 11, wherein the composite handle profile is flush with the fenestration frame with the sash in the closed position.

21. A method for operating a fenestration assembly comprising:

moving a sash with a sash handle of a low profile handle assembly, the sash handle outside of a daylight opening profile of the, wherein:

the sash is moveable relative to a fenestration frame between an open position, a closed position and intermediate positions therebetween;

the sash handle is configured for reception in a handle socket of the fenestration frame; and the sash handle is decoupled from the handle socket and the fenestration frame in the open and intermediate positions;

the sash handle having a grip surface open toward the daylight opening to facilitate access to the sash handle;

closing the fenestration assembly with the low profile handle assembly, closing the fenestration assembly includes:

moving the sash toward the fenestration frame of the fenestration assembly with the sash handle;

seating the sash handle within the handle socket of the fenestration frame, wherein the sash handle is exposed within the daylight opening; and wherein a composite handle profile includes the sash handle received in the handle socket with the sash in the closed position, and the composite handle profile is outside of the daylight opening profile, and the daylight opening is unobstructed at least from the low profile handle assembly.

22. The method of claim 21, wherein moving the sash includes manually pushing or pulling the sash with the sash handle.

23. The method of claim 21, wherein moving the sash includes pulling the sash with the sash handle.

24. The method claim 21, wherein the sash handle includes a handle profile complementary to a socket profile of the handle socket, and seating the sash handle within the handle socket includes seating the complementary handle profile within the socket profile.

25. The method of claim 21 comprising concealing the low profile handle assembly, concealing includes:

recessing the low profile handle assembly into one or more of the fenestration frame or a sash frame of the sash.

26. The method of claim 21 comprising concealing the low profile handle assembly, concealing includes:

coupling a screen frame of a screen assembly along the fenestration frame; and covering each of the handle socket and the sash handle with the screen frame with the sash in a closed position.

27. The method of claim 21 comprising opening the fenestration assembly, opening the fenestration assembly includes:

moving the sash away from the fenestration frame; and unseating the sash handle from the handle socket.

* * * * *